US007524621B2

(12) United States Patent
Burleva et al.

(10) Patent No.: US 7,524,621 B2
(45) Date of Patent: Apr. 28, 2009

(54) METHOD OF PREPARING SILVER CARBOXYLATE SOAPS

(75) Inventors: Lilia P. Burleva, Maplewood, MN (US); David R. Whitcomb, Woodbury, MN (US)

(73) Assignee: Carestream Health, Inc., Rochester, NY (US)

( * ) Notice: Subject to any disclaimer, the term of this patent is extended or adjusted under 35 U.S.C. 154(b) by 5 days.

(21) Appl. No.: 11/859,094

(22) Filed: Sep. 21, 2007

(65) Prior Publication Data

US 2009/0081578 A1 Mar. 26, 2009

(51) Int. Cl.
*G03C 1/00* (2006.01)
*G03C 1/498* (2006.01)
*G03C 5/00* (2006.01)

(52) U.S. Cl. ..... 430/620; 430/350; 430/617; 430/619

(58) Field of Classification Search ..... 430/617, 430/619, 620, 350
See application file for complete search history.

(56) References Cited

U.S. PATENT DOCUMENTS 1,623,499 A 4/1927 Sheppard et al.
2,131,038 A 9/1938 Brooker et al.
2,399,083 A 4/1946 Waller et al.
2,444,605 A 7/1948 Heimnach et al.
2,489,341 A 11/1949 Waller et al.
2,565,418 A 8/1951 Yackel
2,566,263 A 8/1951 Trivelli et al.
2,597,915 A 5/1952 Yutzy et al.
2,614,928 A 10/1952 Yutzy et al.
2,588,765 A 11/1952 Robijns et al.
2,618,556 A 11/1952 Hewitson et al.
2,681,294 A 6/1954 Beguin
2,694,716 A 11/1954 Allen et al.
2,701,245 A 2/1955 Lynn et al.
2,761,791 A 9/1956 Russell
2,839,405 A 6/1958 Jones et al.
2,861,065 A 11/1958 Herrick et al.
2,886,437 A 5/1959 Piper et al.
2,960,404 A 11/1960 Milton et al.
2,992,101 A 7/1961 Jelley et al.
3,074,809 A 1/1963 Owen
3,080,254 A 3/1963 Grant, Jr.
3,094,417 A 6/1963 workman
3,121,060 A 2/1964 Duane
3,206,312 A 9/1965 Sterman et al.
3,220,839 A 11/1965 Herz et al.
3,235,652 A 2/1966 Lindsey
3,241,969 A 3/1966 Hart et al.
3,287,135 A 11/1966 Anderson et al.
3,297,446 A 1/1967 Dunn
3,297,447 A 1/1967 McVeigh
3,330,663 A 7/1967 Weyde et al.
3,428,451 A 2/1969 Trevoy
3,438,776 A 4/1969 Yudelson
3,446,648 A 5/1969 Workman
3,457,075 A 7/1969 Morgan et al.
3,700,458 A 10/1972 Lindholm
3,719,495 A 3/1973 Lea
3,785,830 A 1/1974 Sullivan et al.
3,832,186 A 8/1974 Masuda et al.
3,839,049 A 10/1974 Simons
3,844,797 A 10/1974 Willems et al.
3,847,612 A 11/1974 Winslow
3,874,946 A 4/1975 Costa et al.
3,887,417 A 6/1975 Davies
3,951,660 A 4/1976 Hagemann
4,001,024 A 1/1977 Dittman et al.
4,030,931 A 6/1977 Nogucki et al.
4,076,539 A 2/1978 Ikenoue et al.
4,082,901 A 4/1978 Laridon et al.
4,123,274 A 10/1978 Knight et al.
4,123,282 A 10/1978 Winslow
4,161,408 A 7/1979 Winslow et al.
4,196,002 A 4/1980 Levinson et al.
4,220,709 A 9/1980 deMauriac
4,260,677 A 4/1981 Winslow et al.
4,302,523 A 11/1981 Audran et al.
4,396,712 A 8/1983 Kinoshita et al.
4,439,520 A 3/1984 Kofron et al.
4,504,575 A 3/1985 Lee
4,524,128 A 6/1985 Edwards et al.

(Continued)

FOREIGN PATENT DOCUMENTS

EP 0 227 141 11/1986

(Continued)

OTHER PUBLICATIONS

Ulrich et al., "Thermally Developable Materials Containing Reducing Agent Combinations", U.S. Appl. No. 11/507,550, filed Aug. 21, 2006.

(Continued)

*Primary Examiner*—Thorl Chea

(57) ABSTRACT

Silver salts of long chain carboxylic acids are prepared from long chain carboxylic acids by sequential addition of at least two different alkali metal hydroxides, one of which is lithium hydroxide, followed by converting the mixture of alkali metal carboxylates to silver carboxylates. Photothermographic materials prepared from such silver carboxylates display improved Dmin aging with little if any affect on other sensitometric properties.

20 Claims, No Drawings

U.S. PATENT DOCUMENTS

| | | | |
|---|---|---|---|
| 4,569,863 | A | 2/1986 | Koepke et al. |
| 4,581,329 | A | 4/1986 | Sugimoto et al. |
| 4,582,786 | A | 4/1986 | Ikeda et al. |
| 4,609,621 | A | 9/1986 | Sugimoto et al. |
| 4,675,279 | A | 6/1987 | Shuto et al. |
| 4,678,741 | A | 7/1987 | Yamada et al. |
| 4,690,883 | A | 9/1987 | Kubodera et al. |
| 4,720,451 | A | 1/1988 | Shuto et al. |
| 4,741,992 | A | 5/1988 | Przezdziecki |
| 4,761,361 | A | 8/1988 | Ozaki et al. |
| 4,775,613 | A | 10/1988 | Hirai et al. |
| 4,784,939 | A | 11/1988 | Van Pham |
| 4,818,675 | A | 4/1989 | Miyasaka et al. |
| 4,840,882 | A | 6/1989 | Iwagaki et al. |
| 4,873,184 | A | 10/1989 | Simpson |
| 4,945,036 | A | 7/1990 | Arai et al. |
| 4,952,491 | A | 8/1990 | Nishikawa et al. |
| 5,028,523 | A | 7/1991 | Skoug |
| 5,049,485 | A | 9/1991 | Deaton |
| 5,064,753 | A | 11/1991 | Sohei et al. |
| 5,135,842 | A | 8/1992 | Kitchin et al. |
| 5,149,620 | A | 9/1992 | Simpson et al. |
| 5,158,866 | A | 10/1992 | Simpson et al. |
| 5,175,081 | A | 12/1992 | Krepski et al. |
| 5,250,386 | A | 10/1993 | Aono et al. |
| 5,252,455 | A | 10/1993 | Deaton |
| 5,266,452 | A | 11/1993 | Kitchin et al. |
| 5,281,515 | A | 1/1994 | Delprato et al. |
| 5,298,390 | A | 3/1994 | Sakizadeh et al. |
| 5,300,420 | A | 4/1994 | Kenney et al. |
| 5,310,640 | A | 5/1994 | Markin et al. |
| 5,314,795 | A | 5/1994 | Helland et al. |
| 5,340,613 | A | 8/1994 | Hanzalik et al. |
| 5,358,843 | A | 10/1994 | Sakizadeh et al. |
| 5,368,979 | A | 11/1994 | Freedman et al. |
| 5,368,995 | A | 11/1994 | Christian et al. |
| 5,369,000 | A | 11/1994 | Sakizadeh et al. |
| 5,374,514 | A | 12/1994 | Kirk et al. |
| 5,380,635 | A | 1/1995 | Gomez et al. |
| 5,382,504 | A | 1/1995 | Shor et al. |
| 5,391,727 | A | 2/1995 | Deaton |
| 5,393,654 | A | 2/1995 | Burrows et al. |
| 5,405,740 | A | 4/1995 | LaBelle |
| 5,415,993 | A | 5/1995 | Hanzalik et al. |
| 5,434,043 | A | 7/1995 | Zou et al. |
| 5,441,866 | A | 8/1995 | Miller et al. |
| 5,460,938 | A | 10/1995 | Kirk et al. |
| 5,464,747 | A | 11/1995 | Eisenbeis et al. |
| 5,468,603 | A | 11/1995 | Kub |
| 5,493,327 | A | 2/1996 | McCallum et al. |
| 5,496,695 | A | 3/1996 | Simpson et al. |
| 5,508,162 | A | 4/1996 | Dankosh |
| 5,510,236 | A | 4/1996 | Dankosh |
| 5,525,376 | A | 6/1996 | Leonard |
| 5,532,121 | A | 7/1996 | Yonkoski et al. |
| 5,541,054 | A | 7/1996 | Miller et al. |
| 5,545,505 | A | 8/1996 | Simpson |
| 5,545,507 | A | 8/1996 | Simpson et al. |
| 5,545,515 | A | 8/1996 | Murray et al. |
| 5,558,983 | A | 9/1996 | Simpson et al. |
| 5,594,143 | A | 1/1997 | Kirk et al. |
| 5,599,647 | A | 2/1997 | Defieuw et al. |
| 5,620,840 | A | 4/1997 | Maskasky |
| 5,621,983 | A | 4/1997 | Lundemann et al. |
| 5,635,339 | A | 6/1997 | Murray |
| 5,637,449 | A | 6/1997 | Harring et al. |
| 5,652,091 | A | 7/1997 | Perry et al. |
| 5,654,130 | A | 8/1997 | Murray |
| 5,667,955 | A | 9/1997 | Maskasky |
| 5,672,562 | A | 9/1997 | Goswami et al. |
| 5,686,228 | A | 11/1997 | Murray et al. |
| 5,691,127 | A | 11/1997 | Daubendiek et al. |
| 5,705,324 | A | 1/1998 | Murray |
| 5,716,772 | A | 2/1998 | Taguchi |
| 5,733,608 | A | 3/1998 | Kessel et al. |
| 5,759,761 | A | 6/1998 | Lushington et al. |
| 5,780,207 | A | 7/1998 | Mohapatra et al. |
| 5,795,708 | A | 8/1998 | Boutet |
| 5,804,365 | A | 9/1998 | Bauer et al. |
| 5,843,530 | A | 12/1998 | Jerry et al. |
| 5,849,363 | A | 12/1998 | Yapel et al. |
| 5,861,195 | A | 1/1999 | Bhave et al. |
| 5,891,610 | A | 4/1999 | Bauer et al. |
| 5,891,615 | A | 4/1999 | Winslow et al. |
| 5,912,111 | A | 6/1999 | Lok et al. |
| 5,928,857 | A | 7/1999 | Geisler et al. |
| 5,939,249 | A | 8/1999 | Zou |
| 5,981,151 | A | 11/1999 | Leenders et al. |
| 6,013,420 | A | 1/2000 | Wingender et al. |
| 6,063,560 | A | 5/2000 | Suzuki et al. |
| 6,083,681 | A | 7/2000 | Lynch et al. |
| 6,090,538 | A | 7/2000 | Arai et al. |
| 6,100,022 | A | 8/2000 | Inoue et al. |
| 6,143,487 | A | 11/2000 | Philip et al. |
| 6,146,822 | A | 11/2000 | Asanuma et al. |
| 6,150,084 | A | 11/2000 | Ito et al. |
| 6,165,704 | A | 12/2000 | Miyake et al. |
| 6,171,767 | B1 | 1/2001 | Kong et al. |
| 6,183,947 | B1 * | 2/2001 | Ito ..... 430/619 |
| 6,190,822 | B1 | 2/2001 | Dickerson et al. |
| 6,306,566 | B2 | 10/2001 | Sakurada et al. |
| 6,352,819 | B1 | 3/2002 | Kenney et al. |
| 6,352,820 | B1 | 3/2002 | Bauer et al. |
| 6,355,405 | B1 | 3/2002 | Ludemann et al. |
| 6,355,408 | B1 | 3/2002 | Whitcomb et al. |
| 6,368,779 | B1 | 4/2002 | Lynch et al. |
| 6,387,605 | B1 | 5/2002 | Lynch et al. |
| 6,413,710 | B1 | 7/2002 | Shor et al. |
| 6,413,712 | B1 | 7/2002 | Yoshioka et al. |
| 6,420,102 | B1 | 7/2002 | Bauer et al. |
| 6,423,481 | B1 | 7/2002 | Simpson et al. |
| 6,436,616 | B1 | 8/2002 | Geisler et al. |
| 6,440,649 | B1 | 8/2002 | Simpson et al. |
| 6,455,210 | B1 | 9/2002 | Irving et al. |
| 6,465,162 | B1 | 10/2002 | Kong et al. |
| 6,472,131 | B1 | 10/2002 | Whitcomb |
| 6,475,710 | B2 | 11/2002 | Kudo et al. |
| 6,485,898 | B2 | 11/2002 | Yoshioka et al. |
| 6,514,677 | B1 | 2/2003 | Ramsden et al. |
| 6,514,684 | B2 | 2/2003 | Suzuki et al. |
| 6,558,880 | B1 | 5/2003 | Goswami et al. |
| 6,566,042 | B1 | 5/2003 | Goto et al. |
| 6,573,033 | B1 | 6/2003 | Simpson et al. |
| 6,599,685 | B1 | 7/2003 | Kong |
| 6,620,577 | B1 | 9/2003 | Lynch et al. |
| 6,620,582 | B2 | 9/2003 | Hirabayashi |
| 6,630,283 | B1 | 10/2003 | Simpson et al. |
| 6,645,714 | B2 | 11/2003 | Oya et al. |
| 6,667,148 | B1 | 12/2003 | Rao et al. |
| 6,689,546 | B1 | 2/2004 | LaBelle et al. |
| 6,689,547 | B2 | 2/2004 | Hunt et al. |
| 6,699,647 | B2 | 3/2004 | Lynch et al. |
| 6,699,648 | B2 | 3/2004 | Sakizadeh et al. |
| 6,699,649 | B2 | 3/2004 | Nishijima et al. |
| 6,713,240 | B2 | 3/2004 | Lynch et al. |
| 6,746,831 | B1 | 6/2004 | Hunt |
| 6,762,013 | B2 | 7/2004 | Sakizadeh et al. |
| 6,764,385 | B2 | 7/2004 | Boumerzoug et al. |
| 6,787,298 | B2 | 9/2004 | Goto et al. |
| 6,803,177 | B2 | 10/2004 | Bokhonov et al. |
| 6,841,343 | B2 | 1/2005 | Lynch et al. |
| 6,942,960 | B2 | 9/2005 | Maskasky et al. |
| 7,008,748 | B1 | 3/2006 | Hasberg et al. |
| 7,018,787 | B1 | 3/2006 | Ludemann et al. |

| | | | | |
|---|---|---|---|---|
| 7,022,467 | B1 | 4/2006 | Ludemann et al. | |
| 7,026,105 | B2 | 4/2006 | Simpson et al. | |
| 7,063,941 | B2 | 6/2006 | Burleva et al. | |
| 7,067,242 | B2 | 6/2006 | Ludemann et al. | |
| 7,074,549 | B2 | 7/2006 | Simpson et al. | |
| 7,087,366 | B2 | 8/2006 | Burleva et al. | |
| 7,144,689 | B2 | 12/2006 | Ludemann et al. | |
| 7,169,543 | B2 | 1/2007 | Ramsden et al. | |
| 7,169,544 | B2 | 1/2007 | Chen-Ho et al. | |
| 7,175,978 | B2 | 2/2007 | Maeda | |
| 7,192,695 | B2 | 3/2007 | Sakai et al. | |
| 2004/0053173 | A1 | 3/2004 | Maskasky et al. | |
| 2004/0234906 | A1 | 11/2004 | Ohzeki et al. | |
| 2005/0048422 | A1 | 3/2005 | Nakagawa | |
| 2005/0118542 | A1 | 6/2005 | Mori et al. | |
| 2005/0214702 | A1 | 9/2005 | Ohzeki | |
| 2006/0014111 | A1 | 1/2006 | Goto | |
| 2006/0046932 | A1 | 3/2006 | Ludemann et al. | |
| 2006/0057513 | A1* | 3/2006 | Ito et al. | 430/619 |
| 2006/0141404 | A1 | 6/2006 | Philip, Jr. et al. | |

FOREIGN PATENT DOCUMENTS

| | | |
|---|---|---|
| EP | 0 342 810 | 11/1989 |
| EP | 0 559 228 | 3/1993 |
| EP | 0 600 586 | 9/1993 |
| EP | 0 600 587 | 9/1993 |
| EP | 0 678 776 | 10/1995 |
| EP | 0 600 587 | 2/1996 |
| EP | 0 640 589 | 3/1997 |
| EP | 0 821 271 | 6/1997 |
| EP | 0 915 371 | 10/1998 |
| EP | 1 083 459 | 3/2001 |
| GB | 623448 | 7/1946 |
| GB | 837 095 | 6/1960 |
| GB | 955061 | 6/1962 |
| GB | 1 439 478 | 12/1973 |
| GB | 1 565 043 | 3/1978 |
| JP | 49-13224 | 2/1974 |
| JP | 50-17216 | 2/1975 |
| JP | 51-42529 | 4/1975 |
| JP | 11-302550 | 11/1999 |
| JP | 2000-029168 | 1/2000 |
| JP | 2000-63690 | 2/2000 |
| JP | 2000-112054 | 4/2000 |
| JP | 2000-273329 | 10/2000 |
| JP | 2001-5145 | 1/2001 |
| JP | 2001-51371 | 2/2001 |
| JP | 2001-64527 | 3/2001 |
| JP | 2001-109101 | 4/2001 |
| JP | 2001-142175 | 5/2001 |
| JP | 2001-154305 | 6/2001 |
| JP | 2001-183770 | 7/2001 |

OTHER PUBLICATIONS

Zou et al., Photothermographic Materials Containing Developer and Co-Developer, U.S. Appl. No. 11/611,913, filed Dec. 18, 2006.

Brinckman et al., Unconventional Imaging Processes, The Focal Press, London and New York, 1978, pp. 74-74.

D. H. Klosterboer, Thermally Processed Silver Systems, Van Nostrand-Reinhold, New York, 1989, Chapter 9, pp. 279-291.

Zou et al., Mechanisms of Latent Image Formation in Photothermographic Silver Imaging Media, Journal of Imaging Science and Technology, vol. 40, No. 2, pp. 94-103, Mar./Apr. 1996.

T.H. James, "The Theory of the Photographic Process," Fourth Edition, Eastman Kodak, Rochester, NY, 1977, p. 374.

T.H. James, "The Theory of Photographic Process," Fourth Edition, Eastman Kodak, Rochester, NY, 1977, Chapter 5, pp. 149-169.

T.H. James, "The Theory of the Photographic Process," Fourth Edition, Eastman Kodak, Rochester, NY, 1977, Chapter 2, pp. 77-78.

T.H. James, "The Theory of the Photographic Process," Third Edition, Macmillan, NY, 1966, Chapter 2.

Y. Yoshioka et al., "Development of Rapid Dry Photothermographic Materials with Water-Base Emulsion Coating Method," AgX 2004: The International Symposium on Silver Halide Technology "At the Forefront of Silver Halide Imaging", Final Program and Proceedings of IS&T and SPSTJ, Ventura, CA, Sep. 13-15, 2005, pp. 28-31.

R. A. Elder, "Resistivity Measurements on Buried Conductive Layers," EOS/ESD Symposium Proceedings, Lake Buena Vista, FL, 1990, pp. 251-254.

Particle Size Analysis, ASTM Symposium on Light Microscopy, R. P. Loveland, 1955, pp. 94-122.

Research Disclosure 17029.

Research Disclosure 308119.

J. Sturge et al., New York, 1989, Chapter 9, pp. 279-291.

Research Disclosure (http://www.researchdisclosure.com) is a publication of Kenneth Mason Publications Ltd., The Book Barn, Westbourne, Hampshire POB 10 8RS, UK.

Goto et al., Society for Imaging Science and Technology, Springfield, VA.

Research Disclosure 36544.

* cited by examiner

METHOD OF PREPARING SILVER CARBOXYLATE SOAPS

FIELD OF THE INVENTION

This invention relates to an improved method of preparing silver carboxylate soaps and to the use of such materials in thermographic and photothermographic materials. This invention also relates to methods of imaging and using these materials.

BACKGROUND OF THE INVENTION

Silver-containing direct thermographic and photothermographic imaging materials (that is, thermally developable imaging materials) that are imaged and/or developed using heat and without liquid processing have been known in the art for many years.

Silver-containing direct thermographic imaging materials are non-photosensitive materials that are used in a recording process wherein images are generated by the direct application of thermal energy and in the absence of a processing solvent. These materials generally comprise a support having disposed thereon (a) a relatively or completely non-photosensitive source of reducible silver ions, (b) a reducing composition (acting as a black-and-white silver developer) for the reducible silver ions, and (c) a suitable binder. Thermographic materials are sometimes called "direct thermal" materials in the art because they are directly imaged by a source of thermal energy without any transfer of the image or image-forming materials to another element (such as in thermal dye transfer).

In a typical thermographic construction, the image-forming thermographic layers comprise non-photosensitive reducible silver salts of long chain fatty acids. A preferred non-photosensitive reducible silver source is a silver salt of a long chain aliphatic carboxylic acid having from 10 to 30 carbon atoms, such as behenic acid or mixtures of acids of similar molecular weight. At elevated temperatures, the silver of the silver carboxylate is reduced by a reducing agent for silver ion (also known as a developer), whereby elemental silver is formed. Preferred reducing agents include methyl gallate, hydroquinone, substituted-hydroquinones, hindered phenols, catechols, pyrogallol, ascorbic acid, and ascorbic acid derivatives.

Some thermographic constructions are imaged by contacting them with the thermal head of a thermographic recording apparatus such as a thermal print-head of a thermal printer or thermal facsimile. In such constructions, an anti-stick layer is coated on top of the imaging layer to prevent sticking of the thermographic construction to the thermal head of the apparatus utilized. The resulting thermographic construction is then heated imagewise to an elevated temperature, typically in the range of from about 60 to about 225° C., resulting in the formation of a black-and-white image of silver.

Silver-containing photothermographic imaging materials (that is, photosensitive thermally developable imaging materials) that are imaged with actinic radiation and then developed using heat and without liquid processing, have been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (acting as a developer) for the reducible silver ions, and (d) a binder. The latent image is then developed by application of thermal energy.

In photothermographic materials, exposure of the photosensitive silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image of silver while much of the silver halide, generally, remains as silver halide and is not reduced.

In photothermographic materials, the reducing agent for the reducible silver ions, often referred to as a "developer", may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as reducing agents for photothermographic materials. Upon heating, and at elevated temperatures, the reducible silver ions are reduced by the reducing agent. This reaction occurs preferentially in the regions surrounding the latent image and produces a negative image of metallic silver having a color that ranges from yellow to deep black depending upon the presence of toning agents and other components in the photothermographic imaging layer(s).

Differences Between Photothermography and Photography:

The imaging arts have long recognized that the field of photothermography is clearly distinct from that of photography. Photothermographic materials differ significantly from conventional silver halide photographic materials that require processing with aqueous processing solutions.

In photothermographic imaging materials, a visible image is created in the absence of a processing solvent by heat as a result of the reaction of a reducing agent incorporated within the material. Heating at 50° C. or more is essential for this dry development. In contrast, conventional photographic imaging materials require processing in aqueous processing baths at more moderate temperatures (from 30° C., to 50° C.) to provide a visible image.

In photothermographic materials, only a small amount of silver halide is used to capture light and a non-photosensitive source of reducible silver ions (for example, a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a reducing agent (that is, a developer for the reducible silver ions) while conventional photographic materials usually do not. The incorporation of the reducing agent into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Unconventional Imaging Processes*, E. Brinckman et al. (Eds.), The Focal Press, London and New York, 1978, pp. 74-75, in D. H. Klosterboer, *Imaging Processes and Materials*, (*Neblette's Eighth Edition*), J. Sturge, V. Walworth, and A. Shepp, Eds., Van Nostrand-Reinhold, New York, 1989, Chapter 9, pp. 279-291, in C. Zou et al., J. *Imaging Sci. Technol.* 1996, 40, pp. 94-103, and in M. R. V. Sahyun, *J. Imaging Sci. Technol.* 1998, 42, 23.

Problem to be Solved:

Photothermographic materials are commercially available for use in the medical imaging industry, and are particularly used for diagnosis and archival of clinical images. These materials are currently widely used in regions of the world where viewing and storage of imaged films is done in a controlled environment and at moderate temperature and humidity. However, photothermographic materials are now also being used in regions where the environment for viewing and storage of imaged films is less controlled and the imaged films may be stored at higher temperatures and humidity.

A challenge in photothermographic materials is the need to improve their stability at ambient temperature and relative humidity during storage prior to imaging. This stability is referred to as "Raw Stock Keeping" (RSK), "Natural Age Keeping" (NAK), "Shelf-Life Stability". It is desirable that photothermographic materials be capable of maintaining their imaging properties, including photospeed and Dmax, while minimizing any increase in Dmin during storage periods. Raw Stock Keeping is a problem especially for photothermographic films compared to conventional silver halide photographic films because, as noted above, all the components needed for development and image formation in photothermographic systems are incorporated into the imaging element, in intimate proximity, prior to development. The large number of potentially reactive components that can prematurely react during storage that can lead to loss of photospeed, increase in Dmin, and changes in other sensitometric properties during storage. These problems can become more acute when photothermographic materials are stored prior to use in severe environmental conditions such as high humidity or high temperature.

One particular type of Raw Stock Keeping problem is "Shelf-aging Fog" or "Dmin aging". Shelf-aging fog is the increase in Dmin in non-imaged areas of photothermographic materials. The stored, non-imaged materials, upon later imaging and development have a higher Dmin in non-imaged areas when compared to freshly prepared samples of the same materials that have been imaged soon after coating. Shelf-aging fog shortens the shelf-life of photothermographic materials. A great amount of work has been done to improve the shelf-life characteristics of photothermographic materials. In order to destroy fog centers or to limit their growth during development, additional additives, such as stabilizers and antifoggants, have been incorporated into the imaging layers.

Yet another problem encountered in photothermography is that the photospeed and other sensitometric properties often change as the material ages during storage.

U.S. Pat. No. 4,161,408 (Winslow et al.) describes the preparation of silver halide/silver carboxylate soaps by converting a melted long chain fatty acid in water to an ammonium or a mixture alkali metal salts. Conversion by adding a mixture of sodium and lithium hydroxides is described. The ammonium or alkali metal salts are then converted to the silver salt of the acid.

U.S. Pat. No. 7,175,978 (Maeda et al.) describes the preparation of silver halide/silver carboxylate soaps by converting a melted long chain fatty acid in water to a mixture alkali metal salts. Conversion by adding a mixture of sodium and potassium hydroxides is described. The alkali metal salts are then converted to the silver salt of the acid.

There remains a need for methods to provide photothermographic materials whose photospeed and other sensitometric characteristics undergo little change as the material ages during, storage. That is, photothermographic materials with improved shelf stability are needed.

SUMMARY OF THE INVENTION

To address this need, this invention provides a method of forming a silver soap of a long chain carboxylic acid comprising:

(A) preparing a dispersion of a long chain carboxylic acid in water, with no alkali or ammonia salt of the acid present in the dispersion while the long chain carboxylic acid is maintained above its melting point but below the boiling point of the dispersion, (B) converting a first portion of the long chain carboxylic acid to one or more alkali metal salts of the long chain carboxylic acid by the addition of one or more alkali metal hydroxides (C) converting the remainder of the long chain carboxylic acid to one or more alkali metal salts of the long chain carboxylic acid by the addition of one or more alkali metal hydroxides, (D) cooling the dispersion, and thereafter (E) converting the mixture of alkali metal salts of the long chain carboxylic acid to a silver soap of the long chain carboxylic acid, so long as one of the alkali metal hydroxides in step (B) or (C) but not both is lithium hydroxide.

In one preferred embodiment this method further provides adding preformed silver halide at any step in the process of preparing the silver soap of the long chain carboxylic acid to form a silver halide/silver carboxylate soap.

This invention also provides a method of preparing a photothermographic material comprising:

(A) preparing a dispersion of a long chain carboxylic acid in water, with no alkali or ammonia salt of the acid present in the dispersion while the acid is maintained above its melting point but below the boiling point of the dispersion, (B) converting a first portion of the long chain carboxylic acid to one or more alkali metal salts of the long chain carboxylic acid by the addition of one or more alkali metal hydroxides (C) converting the remainder of the long chain carboxylic acid to one or more alkali metal salts of the long chain carboxylic acid by the addition of one or more alkali metal hydroxides, (D) cooling the dispersion, (E) adding a preformed silver halide, and thereafter (E) converting the mixture of long chain alkali metal salts of the carboxylic acid to a silver soap of the long chain carboxylic acid, so long as one of the alkali metal hydroxides in step (B) or (C) but not both is lithium hydroxide, (F) adding a binder to form a photothermographic emulsion formulation, (G) adding a hindered bis-phenol reducing agent to form a photothermographic coating formulation, and (H) coating and drying the photothermographic emulsion formulation on a support to provide a photothermographic imaging material.

This invention further provides a method of forming a visible image comprising:

(A) imagewise exposing a photothermographic material prepared by the method of this invention to electromagnetic radiation to form a latent image, (B) simultaneously or sequentially, heating the exposed photothermographic material to develop the latent image into a visible image.

We have found that silver carboxylate soaps can be prepared from long chain carboxylic acids by sequential addition of at least two different alkali metal hydroxides, one of which is lithium hydroxide, followed by converting the mixture of alkali metal long chain carboxylates to silver long chain carboxylate soaps. These silver long chain carboxylate soaps can be used to prepare photothermographic materials that having improved Dmin aging with little if any affect on other sensitometric properties. These silver long chain carboxylate soaps can also be used to prepare thermographic materials.

Other aspects, advantages, and benefits of the present invention are apparent from the detailed description, examples, and claims provided in this application.

DETAILED DESCRIPTION OF THE INVENTION

The thermally developable materials described herein are both thermographic and photothermographic materials. While the following discussion will primarily be directed to the preferred photothermographic embodiments employing silver halide/silver carboxylate soaps prepared by the methods described herein, it would be readily understood by one skilled in the art that thermographic materials can be similarly constructed and used to provide black-and-white or color images using appropriate imaging chemistry, the silver carboxylate soaps prepared by the methods described herein, reducing agents, toners, binders, and other components known to a skilled artisan. In both thermographic and photothermographic materials, the silver carboxylate soaps (and the silver halide/silver carboxylate soaps when used in photothermographic materials) are in reactive association with the reducing agent.

The photothermographic materials prepared using the silver halide/silver carboxylate soaps prepared by the methods described herein can be used in black-and-white or color photothermography and in electronically generated black-and-white or color hardcopy recording. They can be used in microfilm applications, in radiographic imaging (for example digital medical imaging), X-ray radiography, and in industrial radiography. Furthermore, the absorbance of these materials between 350 and 450 nm is desirably low (less than 0.5), to permit their use in the graphic arts area (for example, image-setting and phototype-setting), in the manufacture of printing plates, in contact printing, in duplicating ("duping"), and in proofing. Black-and-white imaging is particularly preferred.

The photothermographic materials are particularly useful for imaging of human or animal subjects in response to, X-radiation, ultraviolet, visible, or infrared radiation for use in a medical diagnosis. Such applications include, but are not limited to, thoracic imaging, mammography, dental imaging, orthopedic imaging, general medical radiography, therapeutic radiography, veterinary radiography, and autoradiography. When used with X-radiation, the photothermographic materials may be used in combination with one or more phosphor intensifying screens, width phosphors incorporated within the photothermographic emulsion, or with combinations thereof. Such materials are particularly useful for dental radiography when they are directly imaged by X-radiation. The materials are also useful for non-medical uses of X-radiation such as X-ray lithography and industrial radiography.

The photothermographic materials can be made sensitive to radiation of any suitable wavelength. Thus, in some embodiments, the materials are sensitive at ultraviolet, visible, infrared, or near infrared wavelengths, of the electromagnetic spectrum. In preferred embodiments, the materials are sensitive to radiation greater than 600 nm (and preferably sensitive to infrared radiation from about 700 up to about 950 nm). Increased sensitivity to a particular region of the spectrum is imparted through the use of various spectral sensitizing dyes.

In the photothermographic materials, the components needed for imaging can be in one or more photo thermographic imaging layers on one side ("frontside") of the support. The layer(s) that contain the photosensitive photo-catalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity and preferably are in the same emulsion layer.

Where the photothermographic materials contain imaging layers on one side of the support only, various non-imaging layers are usually disposed on the "backside" (non-emulsion or non-imaging side) of the materials, including conductive/antistatic layers, antihalation layers, protective layers, and transport enabling layers.

Various non-imaging layers can also be disposed on the "frontside" or imaging or emulsion side of the support, including protective frontside overcoat layers, primer layers, interlayers, opacifying layers, conductive/antistatic layers, antihalation layers, acutance layers, auxiliary layers, and other layers readily apparent to one skilled in the art.

For some embodiments, it may be useful that the photothermographic materials be "double-sided" or "duplitized" and have the same or different photothermographic coatings (or imaging layers) on both sides of the support. In such constructions each side can also include one or more protective overcoat layers, primer layers, interlayers, acutance layers, conductive/antistatic layers auxiliary layers, anti-crossover layers, and other layers readily apparent to one skilled in the art, as well as the required conductive layer(s).

When the photothermographic materials are heat-developed as described below in a substantially water-free condition after, or simultaneously with, imagewise exposure, a silver image (preferably a black-and-white silver image) is obtained.

Definitions

As used herein:

In the descriptions of the photothermographic materials, "a" or "an" component refers to "at least one" of that component [for example, the silver halide/silver carboxylate soaps described herein].

As used herein, "black-and-white" preferably refers to an image formed by silver metal, as opposed to an image formed using a combination of dyes or color couplers.

Unless otherwise indicated, when the term "photothermographic materials" is used herein, the term refers to embodiments of the present invention.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water or any other solvent for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a dry processable integral element comprising a support and at least one photothermographic emulsion layer or a photothermographic set of emulsion layers (wherein the silver halide/silver carboxylate soap is in one layer and the other necessary components or additives are distributed, as desired, in the same layer or in an adjacent coated layer). These materials also include multilayer constructions in which one or more imaging components are in different layers, but are in "reactive association". For example, one layer can include the silver halide/silver carboxylate soap and another layer can include the reducing agent (or reducing agent combination) and, but the two reactive components are in reactive association with each other. By "integral", we mean that all imaging chemistry required for imaging is in the material without diffusion of imaging chemistry or reaction products (such as a dye) from or to another element (such as a receiver element).

In photothermography, the term, "imagewise exposing" or "imagewise exposure" means that the material is imaged as a dry processable material using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

The term "emulsion layer", "imaging layer", or "photothermographic emulsion layer" means a layer of a photothermographic material that contains the photosensitive silver halide and non-photosensitive source of reducible silver ions (i.e., the silver halide/silver carboxylate soap). Such layers can also contain additional components or desirable additives. These layers are on what is referred to as the "frontside" of the support.

"Photocatalyst" means a photosensitive compound such as silver halide that, upon exposure to radiation, provides a compound that is capable of acting as a catalyst for the subsequent development of the image-forming material.

"Catalytic proximity" or "reactive association" means that the reactive components are in the same layer or in adjacent layers so that they readily come into contact with each other during imaging and thermal development.

The terms "reducing agent" and "developer" mean the same, and the terms "co-reducing agent" and "co-developer" also mean the same.

"Simultaneous coating" or "wet-on-wet" coating means that when multiple layers are coated, subsequent layers are coated onto the initially coated layer before the initially coated layer is dry. Simultaneous coating can be used to apply layers on the frontside, backside, or both sides of the support.

"Transparent" means capable of transmitting visible light or imaging radiation without appreciable scattering or absorption.

The phrase "alkali metal" refers to group I-A of the periodic table and includes lithium, sodium, potassium, rubidium, and cesium. Because its chemical properties are similar to those of alkali metals, ammonium ($NH_4^+$) will be considered herein as an alkali metal. The phrases alkali metal salts and alkali metal hydroxides are the salts and hydroxides of these metals and ammonium.

The phrases "silver salt" and "organic silver salt" refer to an organic molecule having a bond to a silver atom. Although the compounds so formed are technically silver coordination complexes or silver compounds they are also often referred to as silver salts.

The phrase "aryl group" refers to an organic group derived from an aromatic hydrocarbon or heterocyclic compound by removal of one atom, such as a phenyl group formed by removal of one hydrogen atom from benzene. Thus "aromatic" and "aryl" are meant to include both carbocyclic and heterocyclic aromatic groups.

"Silver Efficiency" is defined as Dmax divided by the total silver coating weight in units of $g/m^2$.

The term "buried layer" means that there is at least one other layer disposed over the layer (such as a "buried" backside conductive layer).

The terms "coating weight", "coat weight", and "coverage" are synonymous, and are usually expressed in weight or moles per unit area such as $g/m^2$ or $mol/m^2$.

"Ultraviolet region of the spectrum" refers to that region of the spectrum less than or equal to 400 nm (preferably from about 100 nm to about 400 nm) although parts of these ranges may be visible to the naked human eye.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed", "speed", or "photographic speed" (also known as sensitivity), absorbance, and contrast have conventional definitions known in the imaging arts. The sensitometric term absorbance is another term for optical density (OD).

Speed-2 is Log1/E+4 corresponding to the density value of 1.0 above Dmin where E is the exposure in ergs/$cm^2$.

Average Contrast-1 ("AC-1") is the absolute value of the slope of the line joining the density points at 0.60 and 2.00 above Dmin.

In photothermographic materials, the term Dmin (lower case) is considered herein as the image density achieved in the non-imaged areas after the photothermographic material is thermally developed. The image density in the non-imaged areas when a freshly prepared photothermographic material is thermally developed will be referred to herein as initial Dmin. The term Dmax (lower case) is the maximum image density achieved in the imaged area of a particular sample after imaging and development.

The term DMIN (upper case) is the density of the non-imaged, undeveloped material. The term DMAX (upper case) is the maximum image density achievable when the photothermographic material is exposed and then thermally developed. DMAX is also known as "Saturation Density".

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula or being a "derivative" of a compound, any substitution that does not alter the bond structure of the formula or the shown atoms within that structure is included within the formula, unless such substitution is specifically excluded by language.

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the skilled artisan as not being inert or harmless.

*Research Disclosure* (http://www.researchdisclosure.com) is a publication of Kenneth Mason Publications Ltd., The Book Barn, Westbourne, Hampshire PO10 8RS, UK. It is also available from Emsworth Design Inc., 200 Park Avenue South, Room 1101, New York, N.Y. 10003.

The Photocatalyst:

As noted above, photothermographic materials include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver iodide are preferred. More preferred is silver bromoiodide in which any suitable amount of iodide is present up to almost 100% silver iodide and more likely up to about 40 mol % silver iodide. Even more preferably, the silver bromoiodide comprises at least 70 mole % (preferably at least 85 mole % and more preferably at least 90 mole %) bromide (based on total silver halide). The remainder of the halide is iodide, chloride, or chloride and iodide. Preferably the additional halide is iodide. Silver bromide and silver bromoiodide are preferred, with the latter silver halide generally having up to 10 mole % silver iodide.

In some embodiments of aqueous-based photothermographic materials, higher amounts of iodide may be present in homogeneous photosensitive silver halide grains, and particularly from about 20 mol % up to the saturation limit of iodide as described, for example, U.S. Patent Application Publication 2004/0053173 (Maskasky et al.).

The silver halide grains may have any crystalline habit or morphology including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of grains with different morphologies can be employed. Silver halide grains having cubic and tabular morphology (or both) are preferred.

The silver halide grains may have a uniform ratio of halide throughout. They may also have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described in U.S. Pat. No. 5,382,504 (Shor et al.). Iridium and/or copper doped core-shell and non-core-shell grains are described in U.S. Pat. No. 5,434,043 (Zou et al.) and U.S. Pat. No. 5,939,249 (Zou). Bismuth(III)-doped high silver iodide emulsions for aqueous-based photothermographic materials are described in U.S. Pat. No. 6,942,960 (Maskasky et al.). All of the above patents are incorporated herein by reference.

In some instances, it may be helpful to prepare the photosensitive silver halide grains in the presence of a hydroxytetraazaindene (such as 4-hydroxy-6-methyl-1,3,3a,7-tetraazaindene) or an N-heterocyclic compound comprising at least one mercapto group (such as I-phenyl-5-mercaptotetrazole) as described in U.S. Pat. No. 6,413,710 (Shor et al.).

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. With this technique, one has the possibility of more precisely controlling the grain size, grain size distribution, dopant levels, and composition of the silver halide, so that one can impart more specific properties to both the silver halide grains and the resulting photothermographic material.

In the photothermographic materials described herein, the predominant amount of the non-photosensitive source of reducible silver ions is formed in the presence of ex-situ-prepared silver halide. In this process, the source of reducible silver ions, such as a long chain fatty acid silver carboxylate (commonly referred to as a silver "soap" or homogenate), is formed in the presence of the preformed silver halide grains. Co-precipitation of the source of reducible silver ions in the presence of silver halide provides a more intimate mixture of the two materials to provide a material often referred to as a "preformed soap" [see U.S. Pat. No. 3,839,049 (Simons)].

In some constructions, a portion of the preformed silver halide grains may be added to and "physically mixed" with the non-photosensitive source of reducible silver ions.

Preformed silver halide emulsions can be prepared by aqueous or organic processes and can be unwashed or washed to remove soluble salts. Soluble salts can be removed by any desired procedure for example as described in U.S. Pat. No. 2,489,341 (Waller et al.), U.S. Pat. No. 2,565,418 (Yackel), U.S. Pat. No. 2,614,928 (Yutzy et al.), U.S. Pat. No. 2,618,556 (Hewitson et al.), and U.S. Pat. No. 3,241,969 (Hart et al.).

It is also effective to use an in-situ process in which a halide- or a halogen-containing compound is added to an organic silver salt to partially convert a portion of the silver of the organic silver salt to silver halide. Inorganic halides (such as zinc bromide, zinc iodide, calcium bromide, lithium bromide, lithium iodide, or mixtures thereof) or an organic halogen-containing compound (such as N-bromosuccinimide or pyridinium hydrobromide perbromide) can be used. The details of such in-situ generation of silver halide are described in U.S. Pat. No. 3,457,075 (Morgan et al.).

It is particularly effective to use a mixture of both preformed and in-situ generated silver halide. The preformed silver halide is preferably present in a preformed soap prepared by the methods described herein.

Additional methods of preparing silver halides and organic silver salts and blending them are described in *Research Disclosure*, June 1978, item 17029, U.S. Pat. No. 3,700,458 (Lindholm) and U.S. Pat. No. 4,076,539 (Ikenoue et al.), and Japan Kokai 49-013224 (Fuji), 50-017216 (Fuji), and 51-042529 (Fuji).

The silver halide grains used in the imaging formulations can vary in average diameter of up to several micrometers (μm) depending on the desired use. Preferred silver halide grains for use in preformed emulsions containing silver carboxylates are cubic grains having a number average particle size of from about 0.01 to about 1.0 μm, more preferred are those having a number average particle size of from about 0.03 to about 0.1 μm. It is even more preferred that the grains have a number average particle size of 0.06 μm or less, and preferred that they have a number average particle size of from about 0.03 to about 0.06 μm. Mixtures of grains of various average particle size can also be used. Preferred silver halide grains for high-speed photothermographic constructions use are tabular grains having an average thickness of at least 0.02 μm and up to and including 0.100 μm, an equivalent circular diameter of at least 0.5 μm and up to and including 8 μm and an aspect ratio of at least 5:1. More preferred are those having an average thickness of at least 0.03 μm and up to and including 0.08 μm, an equivalent circular diameter of at least 0.75 pin and up to and including 6 μm and an aspect ratio of at least 10:1.

The average size of the photosensitive silver halide grains is expressed by the average diameter if the grains are spherical, and by the average of the diameters of equivalent circles for the projected images if the grains are cubic or in other non-spherical shapes. Representative grain sizing methods are described in *Particle Size Analysis*, ASTM Symposium on Light Microscopy, R. P. Loveland, 1955, pp. 94-122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

The one or more light-sensitive silver halides are preferably present in an amount of from about 0.005 to about 0.5 mole, more preferably from about 0.01 to about 0.25 mole, and preferably from about 0.03 to about 0.15 mole, per mole of non-photosensitive source of reducible silver ions.

Chemical Sensitization:

The photosensitive silver halides can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149-169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,446 (Dunn), U.S. Pat. No. 3,297,447 (McVeigh), U.S. Pat. No. 5,049,485 (Deaton), U.S. Pat. No. 5,252,455 (Deaton), U.S. Pat. No. 5,391,727 (Deaton), U.S. Pat. No. 5,759,761 (Lushington et al.), and U.S. Pat. No. 5,912,111 (Lok et al.), and EP 0 915 371A1 (Lok et al.).

Mercaptotetrazoles and tetraazindenes as described in U.S. Pat. No. 5,691,127 (Daubendiek et al.) can also be used as suitable addenda for tabular silver halide grains. Certain substituted and unsubstituted thiourea compounds can be used as chemical sensitizers including those described in U.S. Pat. No. 6,368,779 (Lynch et al.). Still other additional chemical sensitizers include certain tellurium-containing compounds that are described in U.S. Pat. No. 6,699,647 (Lynch et al.), and certain selenium-containing compounds that are described in U.S. Pat. No. 6,620,577 (Lynch et al.). Combinations of gold(III)-containing compounds and either sulfur-, tellurium-, or selenium-containing compounds are also useful as chemical sensitizers as described in U.S. Pat. No. 6,423,481 (Simpson et al.). In addition, sulfur-containing compounds can be decomposed on silver halide grains in an oxidizing environment according to the teaching in U.S. Pat. No. 5,891,615 (Winslow et al.). Examples of sulfur-containing compounds that can be used in this fashion include sulfur-containing spectral sensitizing dyes. Other useful sulfur-containing chemical sensitizing compounds that can be decomposed in an oxidizing environment are the diphenylphosphine sulfide compounds described in U.S. Pat. No. 7,026,105 (Simpson et al.), U.S. Pat. No. 7,063,941 (Burleva et al.), and U.S. Pat. No. 7,087,366 (Burleva et al.).

The chemical sensitizers can be present in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 1 μm.

Spectral Sensitization:

The photosensitive silver halides may be spectrally sensitized with one or more spectral sensitizing dyes that are known to enhance silver halide sensitivity to ultraviolet, visible, and/or infrared radiation (that is, sensitivity within the range of from about 300 to about 1400 nm). It is preferred that the photosensitive silver halide be sensitized to infrared radiation (that is from about 700 to about 950 nm). Non-limiting examples of spectral sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in the preparation of the photothermographic emulsion, but are generally added after chemical sensitization is achieved.

Suitable spectral sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al.), U.S. Pat. No. 5,441,866 (Miller et al.), U.S. Pat. No. 5,508,162 (Dankosh), U.S. Pat. No. 5,510,236 (Dankosh), and U.S. Pat. No. 5,541,054 (Miller et al.), Japan Kokai 2000-063690 (Tanaka et al.), 2000-112054 (Fukusaka et al.), 2000-273329 (Tanaka et al.), 2001-005145 (Arai), 2001-064527 (Oshiyama et al.), and 2001-154305 (Kita et al.) can be used. Useful spectral sensitizing dyes are also described in *Research Disclosure*, December 1989, item 308119, Section IV and *Research Disclosure*, 1994, item 36544, section V. Specific combinations of spectral sensitizing dyes are shown in U.S. Pat. No. 4,581,329 (Sugimoto et al.), U.S. Pat. No. 4,582,786 (Ikeda et al.), U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.).

Also useful are spectral sensitizing dyes that decolorize by the action of light or heat as described in U.S. Pat. No. 4,524,128 (Edwards et al.) and Japanese Kokai 2001-109101 (Adachi), 2001-154305 (Kita et al.), and 2001-183770 (Hanyu et al.).

Dyes and other compounds may be selected for the purpose of supersensitization to attain much higher sensitivity than the sum of sensitivities that can be achieved by using a sensitizer alone. Examples of such supersensitizers include the metal chelating compounds disclosed in U.S. Pat. No. 4,873,184 (Simpson), the large cyclic compounds featuring a heteroatom disclosed in U.S. Pat. No. 6,475,710 (Kudo et al.), the stilbene compounds disclosed in EP 0 821 271 (Uytterhoeven et al.).

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions:

The non-photosensitive source of reducible silver ions in the thermally developable materials is a silver-organic compound that contains reducible silver(I) ions. Such compounds are generally silver salts of silver organic coordinating ligands that are comparatively stable to light and form a silver image when heated to 50° C. or higher in the presence of an exposed photocatalyst (such as silver halide), and a reducing agent composition.

The primary organic silver salt is a silver salt of a long chain aliphatic carboxylic acid (prepared as described herein). Mixtures of silver salts of such aliphatic carboxylic acids are particularly useful where the mixture includes at least silver behenate. The carboxylic acids from which these silver salts are prepared are also often referred to as "fatty carboxylic acids" or "long chain fatty carboxylic acids", or long chain carboxylates.

Useful silver carboxylates include silver salts of long-chain aliphatic carboxylic acids. The aliphatic carboxylic acids generally have aliphatic chains that contain 10 to 30, and preferably 15 to 28, carbon atoms. Examples of such preferred silver salts include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, at least silver behenate is used alone or in mixtures with other silver carboxylates. These silver salts are often referred to as "silver salts of fatty carboxylic acids", "silver salts of long chain carboxylic acids", or more simply as "silver carboxylates". Dispersions of these materials are known as "silver carboxylate soaps" or "silver soaps".

It is also convenient to use silver half soaps such as an equimolar blend of silver carboxylate and carboxylic acid that analyzes for about 14.5% by weight solids of silver in the blend. Such silver half-soaps can be prepared using the methods described herein.

Silver salts other than the silver carboxylates described above can also be prepared and used as described herein. Such silver salts include silver salts of aliphatic carboxylic acids containing a thioether group as described in U.S. Pat. No. 3,330,663 (Weyde et al.).

In addition to the long chain silver carboxylates prepared by the methods described herein minor amounts of other silver salts can be added such as silver salts of dicarboxylic acids, silver salts of sulfonates as described in U.S. Pat. No. 4,504,575 (Lee), silver salts of sulfosuccinates as described in EP 0 227 141A1 (Leenders et al.), silver salts of aryl carboxylic acids (such as silver benzoate), silver salts of acetylenes as described, for example in U.S. Pat. No. 4,761,361 (Ozaki et al.) and U.S. Pat. No. 4,775,613 (Hirai et al.), and silver salts of heterocyclic compounds containing mercapto or thione groups and derivatives as described in U.S. Pat. No. 4,123,274 (Knight et al.) and U.S. Pat. No. 3,785,830 (Sullivan et al.). Additional sources of non-photosensitive reducible silver ions include the core-shell silver salts described in U.S. Pat. No. 6,355,408 (Whitcomb et al.), the silver dimer compounds described in U.S. Pat. No. 6,472,131 (Whitcomb), or the silver core-shell compounds described in U.S. Pat. No. 6,803,177 (Bokhonov et al.). Still further additional sources of non-photosensitive reducible silver ions are the silver salts of compounds containing an imino group including silver salts of benzotriazole and substituted derivatives thereof, silver salts of 1,2,4-triazoles or 1-H-tetrazoles as described in U.S. Pat. No. 4,220,709 (deMauriac), silver salts of imidazoles and imidazole derivatives as described in U.S. Pat. No. 4,260,677 (Winslow et al.), and the silver salt-toner co-precipitated nano-crystals described in U.S. Pat. No. 7,008,748 (Hasberg et al.).

The one or more non-photosensitive sources of reducible silver ions are preferably present in an amount of from about 5% to about 70%, and more preferably from about 10% to about 50%, based on the total dry weight of the emulsion layers. Alternatively stated, the amount of the sources of reducible silver ions is generally from about 0.002 to about 0.2 mol/$m^2$ of the dry photothermographic material (preferably from about 0.01 to about 0.05 mol/$m^2$).

The total amount of silver (from all silver sources) in the photothermographic materials is generally at least 0.002 mol/$m^2$, preferably from about 0.01 to about 0.05 mol/$m^2$, and more preferably from about 0.01 to about 0.02 mol/$m^2$. In other aspects, it is desirable to use total silver (from both silver halide and reducible silver salts) at a coating weight of less than 2.6 g/$m^2$, preferably at least 1 but less than 1.9 g/$m^2$.

Preparation of Silver Carboxylate and Silver Halide/Silver Carboxylate Soaps

We have found that silver salts of long chain carboxylic acids that are prepared from long chain carboxylic acids by sequential addition of at least two different alkali metal hydroxides, one of which is lithium hydroxide, followed by converting the mixture of alkali metal carboxylates to silver carboxylates can be used to prepare photothermographic materials having improved Dmin aging with little if any affect on other sensitometric properties.

Our method comprises forming a silver soap of a long chain carboxylic acid comprising:

(A) preparing a dispersion of a long chain carboxylic acid in water, with no alkali or ammonia salt of the acid present in the dispersion while the long chain carboxylic acid is maintained above its melting point but below the boiling point of the dispersion, (B) converting a first portion of the long chain carboxylic acid to one or more alkali metal salts of the long chain carboxylic acid by the addition of one or more alkali metal hydroxides (C) converting the remainder of the long chain carboxylic acid to one or more alkali metal salts of the long chain carboxylic acid by the addition of one or more alkali metal hydroxides, (D) cooling the dispersion, and thereafter (E) converting the mixture of the long chain alkali metal salts of the long chain carboxylic acid to a silver soap of the long chain carboxylic acid, so long as one of the alkali metal hydroxides in step (B) or (C) but not both is lithium hydroxide.

Our improved method of preparing a silver soap of a long chain carboxylic acid involves the sequential addition of at least two alkali metal hydroxides (MOH) or ($NH_4OH$), one of which is lithium hydroxide (LiOH). For example, addition of a first solution of at least one metal hydroxide converts a portion of the carboxylic acid to the alkali metal carboxylate (or mixture of alkali metal carboxylates). Subsequent addition of a second solution of one or more metal hydroxides converts the remainder of the carboxylic acid to the alkali metal carboxylate. At least one of the metal hydroxides must be lithium hydroxide.

In one embodiment, the first solution contains lithium hydroxide and the second solution contains sodium hydroxide, potassium hydroxide, ammonium hydroxide or mixtures, thereof, In a preferred embodiment, the first solution contains sodium hydroxide, potassium hydroxide, ammonium hydroxide, or mixtures thereof, and the second solution contains lithium hydroxide. It is preferred that the first solution contain sodium hydroxide and the second solution contain lithium hydroxide.

The silver soaps of long chain carboxylic acids prepared by the methods described herein can be used to prepare direct thermographic emulsions. Coating formulations comprising these emulsions, a binder, and a developer can be coated to prepare thermographic materials.

In one embodiment this method further comprises adding preformed silver halide grains at any step in the process of preparing the silver soap of the long chain carboxylic acid to form a silver halide/silver carboxylate soap.

In a preferred embodiment, the method further comprises forming a silver halide/silver carboxylate soap by the addition of silver halide grains prior to the conversion of the mixture of alkali metal salts of the long chain carboxylic acid to its silver salt. The silver halide grains may be added before the first alkali metal hydroxide solution, between the addition of the first and second alkali metal hydroxide solutions, or after the addition of the second alkali metal hydroxide solutions. It is more preferred that the silver halide grains be preformed and added after the second alkali metal hydroxide solution.

The silver halide/silver carboxylate soaps prepared by the methods described herein can be used to prepare photothermographic emulsions. Coating formulations comprising these emulsions, a binder, and a developer can be coated to prepare photothermographic materials.

The amount of lithium hydroxide used can be from about 2 to about 80 mole %. Preferably the amount of lithium hydroxide is from about 5 to about 25 mol %).

The time between the sequential additions of the metal hydroxide solutions is not critical, but sufficient time should be allowed after the addition of the first metal hydroxide solution for the carboxylic acid to be converted to the first alkali metal salt before adding the second metal hydroxide. Preferably the time between additions of the metal hydroxide solutions should be between about 1 and 60 minutes and more preferably between 5 and 30 minutes, and preferably between 10 and 20 minutes.

This method provides high yields of silver carboxylate and silver halide/silver carboxylate soaps due to the extremely low solubility of the silver soap in water. The precipitated silver soaps can be readily collected by filtration. When used to prepare silver halide/silver carboxylate soaps, washing with water readily removes the water soluble alkali metal nitrates formed as byproducts.

While not completely understood, we believe that our method of preparing silver soaps of long chain carboxylate acids makes use of the Krafft temperatures of the various alkali metal soaps of long chain carboxylic acids. The Krafft temperature refers to the temperature at which the solubility of a dispersion of an alkali metal soap of a long chain carboxylic acid undergoes a sharp, discontinuous increase with increasing temperature. The solubility of the alkali metal soap of the long chain carboxylic acid will increase slowly with an increase in temperature up to the temperature point at which the solubility exhibits an extremely sharp rise. The temperature corresponding to the sharp rise in solubility is the Krafft temperature. Above the Krafft temperature, the alkali metal soap of the long chain carboxylic acid solution becomes a homogeneous phase. Most alkali metal (and ammonium) soaps of long chain carboxylic acids have a Krafft temperature below the boiling point of the solvent used for preparing the dispersion and if heated above the Krafft temperature will form a homogenous solution. Lithium soaps of long chain carboxylic acids, however, do not have a Krafft temperature below the boiling point of the solvents used to prepare these dispersions and will not form a homogenous solution. Lithium soaps of long chain carboxylates may not even have a Krafft temperature.

Upon heating an aqueous dispersion of long chain carboxylic acid(s) the acid melts and forms an oil-in-water dispersion of the acid. Addition of an alkali metal hydroxide forms alkali metal soap crystals of the long chain carboxylic acid. If the temperature of the dispersion is below the Krafft temperature of the alkali metal soap of the long chain carboxylic acid, the acid will be converted to its alkali metal soap. If the temperature at which the alkali metal hydroxide is added is above the Krafft temperature of the alkali metal soap of the long chain carboxylic acid, the acid will be converted to a solution of its alkali metal long chain carboxylate. Cooling below the Krafft temperature will regenerate the alkali metal soap crystals of the long chain carboxylic acid. However, as noted above, lithium soaps of long chain carboxylic acids do not have a Krafft temperature and will never form a homogenous solution. Upon addition of lithium hydroxide the lithium soap of the long chain carboxylate will form. Thus, depending on the temperature of the dispersion and the order of addition of the alkali metal hydroxide the following soap formation conditions may result.

If the non-lithium alkali metal long chain carboxylate is first formed and the lithium hydroxide is then added at a temperature below the Krafft temperature of the non-lithium alkali metal soaps of the long chain carboxylic acids, the lithium soap of the long chain carboxylic acid will be formed in the presence of the non-lithium soap crystals of the long chain carboxylic acid.

If the non-lithium alkali metal long chain carboxylate is first formed and lithium hydroxide is then added at a temperature above the Krafft temperature of the non-lithium alkali metal soaps of the long chain carboxylic acids, the lithium soap of the long chain carboxylic acid will be formed in the presence of a solution of the non-lithium soaps of the long chain carboxylic acid. Upon cooling below the Krafft temperature, the non-lithium alkali metal soap crystals of the long chain carboxylic acid will be formed in the presence of the lithium soap of the long chain carboxylic acid.

If the lithium alkali metal soap of the long chain carboxylic acid is first formed and the non-lithium alkali metal hydroxide is then added at a temperature below the Krafft temperature of the non-lithium alkali metal soaps of the long chain carboxylic acids, the non-lithium alkali metal soap crystals of the long chain carboxylic acid will be formed in the presence of the lithium soap crystals of the long chain carboxylic acid.

If the lithium alkali metal soap of the long chain carboxylic acid is first formed and the non-lithium alkali metal hydroxide is then added at a temperature above the Krafft temperature of the non-lithium alkali metal soaps of the long chain carboxylic acids, a solution of the non-lithium soap of the long chain carboxylic acid will be formed in the presence of lithium soap crystals of the long chain carboxylic acid. Upon cooling below the Krafft temperature, the non-lithium alkali metal soap crystals of the long chain carboxylic acid will be formed in the presence of the lithium soap crystals of the long chain carboxylic acid.

While not completely understood, we believe that this sequential method of alkali addition may affect the structure of the alkali metal carboxylate and thus the ultimate structure of the silver carboxylate and/or the silver halide/silver carboxylate interface. More specifically, we have found that this method of soap preparation affects the soap crystallinity: the higher the amount of lithium hydroxide used in preparing the in the alkali metal carboxylate soap, the lower is the degree of crystallinity of the final silver carboxylate soap. X-ray diffraction patterns indicate that silver halide/silver carboxylate soaps prepared by sequential addition of sodium hydroxide solution followed by addition of lithium hydroxide solution display a peak that does not correspond to either the silver or lithium long chain carboxylates. This peak may be indicative of a solid solution of the silver and lithium long chain carboxylates.

Reducing Agent:

The reducing agent (or reducing agent composition comprising two or more components) for the source of reducible silver ions can be any material (preferably an organic material) that can reduce silver (1+) ion to metallic silver. The "reducing agent" is sometimes called a "developer" or "developing agent".

When a silver carboxylate silver source is used in a photothermographic material, one or more hindered phenol or hindered bis-phenol reducing agents are preferred. In some instances, the reducing agent composition comprises two or more components such as a hindered phenol or hindered bis-phenol developer and a co-developer that can be chosen from the various classes of co-developers and reducing agents described below. Ternary developer mixtures involving the further addition of contrast enhancing agents are also useful. Such contrast enhancing agents can be chosen from the various classes of reducing agents described below.

"Hindered phenol reducing agents" are compounds that contain only one hydroxy group on a given phenyl ring and have at least one additional substituent located ortho to the hydroxy group.

One type of hindered phenol reducing agents is hindered phenols and hindered naphthols. This type of hindered phenol includes, for example, 2,6-di-t-butyl-4-methylphenol, 2,6-di-t-butyl-4-bemzylphenol 2-benzyl-4-methyl-6-t-butylphenol, 2,4-dimethyl-6-(1'-methylcyclohexyl)phenol, and 3,5-bis(1,1-dimethylethyl)-4-hydroxy-benzenepropanoic acid 2,2-bis[[3-[3,5-bis(1,1-dimethylethyl)-4-hydroxyphenyl]-1-oxo-propoxy]methyl]-1,3-propanediyl ester (IRGANOX® 1010).

Another type of hindered phenol reducing agent includes hindered bis-phenols. "Hindered bis-phenols" contain more than one hydroxy group each of which is located on a different phenyl ring. This type of hindered phenol includes, for example, binaphthols (that is dihydroxybinaphthyls), biphenols (that is dihydroxybiphenyls), bis(hydroxynaphthyl) methanes, bis(hydroxyphenyl)methanes, bis(hydroxyphenyl)ethers, bis(hydroxyphenyl)sulfones, and bis (hydroxyphenyl)thioethers, each of which may have additional substituents.

Particularly useful hindered bis-phenol reducing agents are bis(hydroxyphenyl)methanes such as, bis(2-hydroxy-3-t-butyl-5-methylphenyl)methane, 1,1'-bis(2-hydroxy-3,5-dimethylphenyl)-3,5,5-trimethylhexane bis[2-hydroxy-3-(1-methylcyclohexyl)-5-methylphenyl)methane, 2,6-bis[(2-hydroxy-3,5-dimethylphenyl)methyl]-4-methylphenol, 1,1'-bis(2-hydroxy-3,5-dimethylphenyl)isobutane, and 2,6-bis[(2-hydroxy-3,5-dimethylphenyl)methyl]-4-methylphenol. Such hindered bis-phenol compounds also have at least one substituent ortho to the hydroxyl group and are often referred to as "hindered ortho-bis-phenols".

Additional useful reducing agents include bis-phenols having non-aromatic cyclic groups attached to the linking methylene group as described for example, in U.S. Pat. No. 6,699,649 (Nishijima et al.), bis-phenols having cycloaliphatic or alkylene groups attached to the linking methylene group as described for example in U.S. Pat. No. 7,192,695 (Sakai et al.), and bis-phenols having secondary or tertiary substituents on the phenol rings as described for example, in U.S. Pat. No. 6,485,898 (Yoshioka et al.).

In some embodiments, useful reducing agents are bis-phenol developers incorporating bicyclic and tricyclic substituents ortho to the hydroxyl group on the aromatic rings (ortho-bicyclic or tricyclic substituted bis-phenol developers). Such reducing agents are described in U.S. Pat. No. 7,241,561 (Lynch et al.). Also useful are the mixture of phenolic reducing agents described in U.S. Patent Application Publication 2008/0057450 (Ulrich et al.). Additionally useful are the combinations of tris-phenol reducing agents and substituted olefinic co-developers as described in U.S. Patent Application Publication 2008/0145801 (Zou et al.). All of the above patent documents are incorporated herein by reference.

Mixtures of hindered phenol reducing agents can be used if desired, such as the mixture of a hindered phenol and a hindered bis-phenol described in U.S. Pat. No. 6,413,712 (Yoshioka et al.) and U.S. Pat. No. 6,645,714 (Oya et al.).

Still other optional reducing agents include the bis-phenol-phosphorous compounds described in U.S. Pat. No. 6,514,684 (Suzuki et al), the bis-phenol, aromatic carboxylic acid, hydrogen bonding compound mixture described in U.S. Pat. No. 6,787,293 (Yoshioka), and the compounds that can be one-electron oxidized to provide a one-electron oxidation product that releases one or more electrons as described in U.S. Pat. No. 7,303,864 (Ohzeki). Still other useful reducing agents are described in U.S. Pat. No. 3,074,809 (Owen), U.S. Pat. No. 3,080,254 (Grant, Jr.), U.S. Pat. No. 3,094,417 (Workman), U.S. Pat. No. 3,887,417 (Klein et al.), U.S. Pat. No. 4,030,931 (Noguchi et al.), and U.S. Pat. No. 5,981,151 (Leenders et al.).

Additional reducing agents that may be used include amidoximes, azines, a combination of aliphatic carboxylic acid aryl hydrazides and ascorbic acid, a reductone and/or a hydrazine, piperidinohexose reductone or formyl-4-methylphenylhydrazine, hydroxamic acids, a combination of azines and sulfonamidophenols, α-cyanophenylacetic acid derivatives, reductones, indane-1,3-diones, chromans, 1,4-dihydropyridines, and 3-pyrazolidones.

Useful co-developer reducing agents can also be used as described in U.S. Pat. No. 6,387,605 (Lynch et al.). Additional classes of reducing agents that can be used as co-developer reducing agents are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). Yet another class of co-developers includes substituted acrylonitrile compounds such as the compounds identified as HET-01 and HET-02 in U.S. Pat. No. 5,635,339 (Murray) and CN-01 through CN-13 in U.S. Pat. No. 5,545,515 (Murray et al.).

Other useful co-developer reducing agents are the substituted acrylonitriles having phosphonium cations as described in U.S. Patent Application Publication 2008/0145788 (Simpson et al.) and the olefinic co-developers as described in U.S. Patent Application Publication 2008/0145801 (Zou et al.) both of which are incorporated herein by reference.

Various contrast enhancing agents can be added. Such materials are useful for preparing printing plates and duplicating films useful in graphic arts, or for nucleation of medical diagnostic films. Examples of such agents are described in U.S. Pat. No. 6,150,084 (Ito et al.), U.S. Pat. No. 6,620,582 (Hirabayashi), and U.S. Pat. No. 6,764,385 (Watanabe et al.). Certain contrast enhancing agents are preferably used in some photothermographic materials with specific co-reducing agents. Examples of useful contrast enhancing agents include, but are not limited to, hydroxylamines, alkanolamines and ammonium phthalamate compounds as described in U.S. Pat. No. 5,545,505 (Simpson), hydroxamic acid compounds as described for example, in U.S. Pat. No. 5,545,507 (Simpson et al.), N-acylhydrazine compounds as described in U.S. Pat. No. 5,558,983 (Simpson et al.), and hydrogen atom donor compounds as described in U.S. Pat. No. 5,637,449 (Harring et al.).

The reducing agent (or mixture thereof) described herein is generally present at from about 1 to about 25% (dry weight) of the photothermographic emulsion layer in which it is located. In multilayer constructions, if the reducing agent is added to a layer other than a photothermographic emulsion layer, slightly higher proportions, of from about 2 to 35 weight % may be more desirable. Thus, the total range for the reducing agent is from about 1 to about 35% (dry weight). Also, the reducing agent (or mixture thereof) described herein is generally present in an amount of at least 0.1 and up to and including 0.5 mol/mol of total silver in the photothermographic material, and typically in an amount of from about 0.1 to about 0.4 mol/mol of total silver. Co-developer reducing agents may be present generally in an amount of from about 0.001% to about 20% (dry weight) of the emulsion layer coating.

Other Addenda:

The photothermographic materials can also contain other additives such as shelf-life stabilizers, antifoggants, toners, development accelerators, acutance dyes, post-processing stabilizers or stabilizer precursors, thermal solvents (also known as melt formers), antistatic or conductive layers, and other image-modifying agents as would be readily apparent to one skilled in the art.

Suitable stabilizers that can be used alone or in combination include thiazolium salts as described in U.S. Pat. No. 2,131,038 (Brooker) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135, (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), and the heteroaromatic mercapto compounds or heteroaromatic disulfide compounds described in EP 0 559 228B1 (Philip et al.).

Heteroaromatic mercapto compounds are preferred. Preferred heteroaromatic mercapto compounds include 2-mercaptobenzimidazole, 2-mercapto-5-methylbenzimidazole, 2-mercaptobenzothiazole and 2-mercaptobenzoxazole, and mixtures thereof. A heteroaromatic mercapto compound is generally present in an emulsion layer in an amount of at least 0.0001 mole (preferably from about 0.001 to about 1.0 mole) per mole of total silver in the emulsion layer.

Other useful antifoggants/stabilizers are described in U.S. Pat. No. 6,083,681 (Lynch et al.). Still other antifoggants are hydrobromic acid salts of heterocyclic compounds (such as pyridinium hydrobromide perbromide) as described in U.S. Pat. No. 5,028,523 (Skoug), benzoyl acid compounds as described in U.S. Pat. No. 4,784,939 (Pham), substituted propenenitrile compounds as described in U.S. Pat. No. 5,686,228 (Murray et al.), silyl blocked compounds as described in U.S. Pat. No. 5,358,843 (Sakizadeh et al.), the 1,3-diaryl-substituted urea compounds described in U.S. Pat. No. 7,261,999 (Hunt et al.), and tribromomethylketones as described in EP 0 600 587A1 (Oliff et al.).

Additives useful as stabilizers for improving dark stability and desktop print stability are the various boron compounds described in U.S. Patent Application Publication 2006/0141404 (Philip et al.). The boron compounds are preferably added in an amount of from about 0.010 to about 0.50 g/m$^2$.

Also useful as stabilizers for improving the post-processing print stability of the imaged material to heat during storage (known as "hot-dark print stability") are arylboronic acid compounds as described in U.S. Pat. No. 7,255,928 (Chen-Ho et al.) and sulfonyldiphenols as described U.S. Pat. No. 7,258,967 (Sakizadeh et al.), both incorporated herein by reference.

The photothermographic materials preferably also include one or more polyhalogen stabilizers that can be represented by the formula Q-$(Y)_n$—$C(Z_1Z_2X)$ wherein, Q represents an alkyl, aryl (including heteroaryl) or heterocyclic group, Y represents a divalent linking group, n represents 0 or 1, $Z_1$ and $Z_2$ each represents a halogen atom, and X represents a hydrogen atom, a halogen atom, or an electron-withdrawing group. Particularly useful compounds of this type are polyhalogen stabilizers wherein Q represents an aryl group, Y represents (C═O) or $SO_2$, n is 1, and $Z_1$, $Z_2$, and X each represent a bromine atom. Examples of such compounds containing —$SO_2CBr_3$ groups are described in U.S. Pat. No. 3,874,946 (Costa et al.), U.S. Pat. No. 5,369,000 (Sakizadeh et al.), U.S. Pat. No. 5,374,514 (Kirk et al.), U.S. Pat. No. 5,460,938 (Kirk et al.), U.S. Pat. No. 5,464,747 (Sakizadeh et al.) and U.S. Pat. No. 5,594,143 (Kirk et al.). Examples of such compounds include, but are not limited to, 2-tribromomethylsulfonyl-5-methyl-1,3,4-thiadiazole, 2-tribromomethylsulfonylpyridine, 2-tribromomethylsulfonylquinoline, and 2-tribromomethylsulfonylbenzene. The polyhalogen stabilizers can be present in one or more layers in a total amount of from about 0.005 to about 0.01 mol/mol of total silver, and preferably from about 0.01 to about 0.05 mol/mol of total silver.

Stabilizer precursor compounds capable of releasing stabilizers upon application of heat during imaging can also be used, as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.). Also useful are the blocked aliphatic thiol compounds described in U.S. Pat. No. 7,169,543 (Ramsden et al.).

In addition, certain substituted-sulfonyl derivatives of benzotriazoles may be used as stabilizing compounds as described in U.S. Pat. No. 6,171,767 (Kong et al.).

"Toners" or derivatives thereof that improve the image are desirable components of the photothermographic materials. These compounds, when added to the imaging layer, shift the color of the image from yellowish-orange to brown-black or blue-black. Generally, one or more toners described herein are present in an amount of from about 0.01% to about 10% (more preferably from about 0.1% to about 10%), based on the total dry weight of the layer in which the toner is included. Toners may be incorporated in the photothermographic emulsion or in an adjacent non-imaging layer.

Compounds useful as toners are described in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Additional useful toners are substituted and unsubstituted mercaptotriazoles as described in U.S. Pat. No. 3,832,186 (Masuda et al.), U.S. Pat. No. 6,165,704 (Miyake et al.), U.S. Pat. No. 5,149,620 (Simpson et al.), U.S. Pat. No. 6,713,240 (Lynch et al.), and U.S. Pat. No. 6,841,343 (Lynch et al.).

Phthalazine and phthalazine derivatives [such as those described in U.S. Pat. No. 6,146,822 (Asanuma et al.)], phthalazinone, and phthalazinone derivatives are particularly useful toners.

Useful phthalazinone compounds are those having sufficient solubility to completely dissolve in the formulation from which they are coated. Preferred phthalazinone compounds include 6,7-dimethoxy-1-(2H)-phthalazinone, 4-(4-pentylphenyl)-1-(2H)-phthalazinone, and 4-(4-cyclohexylphenyl)-1-(2H)-phthalazinone. Mixtures of such phthalazinone compounds can be used if desired.

The addition of development accelerators that increase the rate of image development and allow reduction in silver coating weight is also useful. Suitable development accelerators include phenols, naphthols, and hydrazinecarboxamides. Such compounds are described, for example, in Y. Yoshioka, K. Yamane, T. Ohzeki, *Development of Rapid Dry Photothermographic Materials with Water-Base Emulsion Coating Method*, AgX 2004: The International Symposium on Silver Halide Technology "At the Forefront of Silver Halide Imaging", Final Program and Proceedings of IS&T and SPSTJ, Ventura, Calif., Sept. 13-15, 2004, pp. 28-31, Society for Imaging Science and Technology, Springfield, Va., U.S. Pat. No. 6,566,042 (Goto et al.), U.S. Pat. No. 7,129,032 (Mori et al.), and U.S. Pat. No. 7,267,934 (Goto), and U.S. Patent Application Publications 2004/234906 (Ohzeki et al.) and 2005/048422 (Nakagawa).

Thermal solvents (or melt formers) can also be used, including combinations of such compounds (for example, a combination of succinimide and dimethylurea). Thermal solvents are compounds which are solids at ambient temperature but which melt at the temperature used for processing. The thermal solvent acts as a solvent for various components of the photothermographic material, it helps to accelerate thermal development and it provides the medium for diffusion of various materials including silver ions and/or complexes and reducing agents. Known thermal solvents are disclosed in U.S. Pat. No. 3,438,776 (Yudelson), U.S. Pat. No. 5,064,753 (noted above) U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender). Thermal solvents are also described in U.S. Pat. No. 7,169,544 (Chen-Ho et al.).

The photothermographic materials can also include one or more image stabilizing compounds that are usually incorporated in a "backside" layer. Such compounds can include phthalazinone and its derivatives, pyridazine and its derivatives, benzoxazine and benzoxazine derivatives, benzothiazine dione and its derivatives, and quinazoline dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al) and GB 1,565,043 (Fuji Photo).

Phosphors are materials that emit infrared, visible, or ultraviolet radiation upon excitation and can be incorporated into the photothermographic materials. Particularly useful phosphors are sensitive to X-radiation and emit radiation primarily in the ultraviolet, near-ultraviolet, or visible regions of the spectrum (that is, from about 100 to about 700 nm). An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants or activators "activate" the phosphor and cause it to emit ultraviolet or visible radiation. Multiple dopants may be used and thus the phosphor would include both "activators" and "co-activators".

Any conventional or useful phosphor can be used, singly or in mixtures. For example, useful phosphors are described in numerous references relating to fluorescent intensifying screens as well as U.S. Pat. No. 6,440,649 (Simpson et al.) and U.S. Pat. No. 6,573,033 (Simpson et al.) that are directed to photothermographic materials. Some particularly useful phosphors are primarily "activated" phosphors known as phosphate phosphors and borate phosphors. Examples of these phosphors are rare earth phosphates, yttrium phosphates, strontium phosphates, or strontium fluoroborates (including cerium activated rare earth or yttrium phosphates, or europium activated strontium fluoroborates) as described in U.S. Pat. No. 7,074,549 (Simpson et al.).

The one or more phosphors can be present in the photothermographic materials in an amount of at least 0.1 mole per mole, and preferably from about 0.5 to about 20 mole, per mole of total silver in the photothermographic material. As noted above, generally, the amount of total silver is at least 0.002 mol/$m^2$. While the phosphors can be incorporated into any imaging layer on one or both sides of the support, it is preferred that they be in the same layer(s) as the photosensitive silver halide(s) on one or both sides of the support.

Binders:

The photosensitive silver halide, the non-photosensitive source of reducible silver ions prepared as described herein, the reducing agent composition, and any other imaging layer additives are generally combined with one or more binders that are generally hydrophobic or hydrophilic in nature. Thus, either aqueous or organic solvent-based formulations can be used to prepare the thermally developable materials. Mixtures of either or both types of binders can also be used. It is preferred that the binder be selected from predominantly hydrophobic polymeric materials (at least 50 dry weight % of total binders) and that the imaging layer formulation (and other layer formulations) is coated out of one or more organic solvents (described below).

Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral, polyvinyl acetal, and polyvinyl formal) and vinyl copolymers (such as polyvinyl acetate and polyvinyl chloride) are particularly preferred. Particularly suitable hydrophobic binders are polyvinyl butyral resins that are available under the names MOWITAL® (Kuraray America, New York, N.Y.), S-LEC® (Sekisui Chemical Company, Troy, Mich.), BUTVAR® (Solutia, Inc., St. Louis, Mo.) and PIOLOFORM® (Wacker Chemical Company, Adrian, Mich.).

Hydrophilic binders or water-dispersible polymeric latex polymers can also be present in the formulations. Examples of useful hydrophilic binders include, but are not limited to, proteins and protein derivatives, gelatin and gelatin-like derivatives (hardened or unhardened), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides and other synthetic or naturally occurring vehicles commonly known for use in aqueous-based photographic emulsions (see for example, *Research Disclosure*, item 38957, noted above). Cationic starches can also be used as a peptizer for tabular silver halide grains as described in U.S. Pat. No. 5,620,840 (Maskasky) and U.S. Pat. No. 5,667,955 (Maskasky).

One embodiment of the polymers capable of being dispersed in aqueous solvent includes hydrophobic polymers such as acrylic polymers, polyester, rubber (for example, SBR resin), polyurethane, poly(vinyl chloride), poly(vinyl acetate), poly(vinylidene chloride), polyolefin, and the like. As the polymers above, usable are straight chain polymers, branched polymers, or crosslinked polymers. Also usable are the so-called homopolymers in which single monomer is polymerized, or copolymers in which two or more types of monomers are polymerized. In the case of a copolymer, it may be a random copolymer or a block copolymer. The molecular weight of these polymers is, in number average molecular weight, in the range from 5,000 to 1,000,000, preferably from 10,000 to 200,000. Those having too small molecular weight exhibit insufficient mechanical strength on forming the image-forming layer, and those having too large molecular weight are also not preferred because the filming properties result poor. Further, crosslinking polymer latexes are particularly preferred for use.

Styrene-butadiene copolymers are particularly preferable as the polymer latex for use as a binder. The weight ratio of monomer unit for styrene to that of butadiene constituting the styrene-butadiene copolymer is preferably in the range of from 40:60 to 95:5. Further, the monomer unit of styrene and that of butadiene preferably account for 60% by weight to 99% by weight with respect to the copolymer. Moreover, the polymer latex contains acrylic acid or methacrylic acid, preferably, in the range from 1% by weight to 6% by weight, and more preferably, from 2% by weight to 5% by weight, with respect to the total weight of the monomer unit of styrene and that of butadiene. The preferred range of the molecular weight is the same as that described above.

Preferred latexes include styrene (50)-butadiene (47)-methacrylic acid (3), styrene (60)-butadiene (35)-divinylbenzene-methyl methacrylate (3)-methacrylic acid (2), styrene (70.5)-butadiene (26.5)-acrylic acid (3) and commercially available LACSTAR-3307B, 7132C, and Nipol Lx416. Such latexes are described in U.S. Pat. No. 7,192,695 (noted above).

Hardeners for various binders may be present if desired. Useful hardeners are well known and include diisocyanate compounds as described in EP 0 600 586 B1 (Philip, Jr. et al.), vinyl sulfone compounds as described in U.S. Pat. No. 6,143,487 (Philip, Jr. et al.) and EP 0 640 589 A1 (Gathmann et al.), aldehydes and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process*, Fourth Edition, Eastman Kodak Company, Rochester, N.Y., 1977, Chapter 2, pp. 77-8.

Where the proportions and activities of the photothermographic materials require a particular developing time and temperature, the binder(s) should be able to withstand those conditions. When a hydrophobic binder is used, it is preferred that the binder (or mixture thereof) does not decompose or lose its structural integrity at 120° C. for 60 seconds. When a hydrophilic binder is used, it is preferred that the binder does not decompose or lose its structural integrity at 150° C. for 60 seconds. It is more preferred that the binder not decompose or lose its structural integrity at 177° C. for 60 seconds.

The polymer binder(s) is used in an amount sufficient to carry the components dispersed therein. Preferably, a binder is used at a level of from about 10% to about 90% by weight (more preferably at a level of from about 20% to about 70% by weight) based on the total dry weight of the layer. It is particularly useful that the photothermographic materials include at least 50 weight % hydrophobic binders in both imaging and non-imaging layers on both sides of the support (and particularly the imaging side of the support).

Support Materials:

The photothermographic materials comprise a polymeric support that is preferably a flexible, transparent film that has any desired thickness and is composed of one or more polymeric materials. They are required to exhibit dimensional stability during thermal development and to have suitable adhesive properties with overlying layers. Useful polymeric materials for making such supports include polyesters [such as poly(ethylene terephthalate) and poly(ethylene naphthalate)], cellulose acetate and other cellulose esters, polyvinyl acetal, polyolefins, polycarbonates, and polystyrenes. Preferred supports are composed of polymers having good heat stability, such as polyesters and polycarbonates. Support materials may also be treated or annealed to reduce shrinkage and promote dimensional stability.

Also useful are transparent, multilayer, polymeric supports comprising numerous alternating layers of at least two different polymeric materials as described in U.S. Pat. No. 6,630,283 (Simpson et al.). Another support comprises dichroic mirror layers as described in U.S. Pat. No. 5,795,708 (Boutet).

Opaque supports can also be used, such as dyed polymeric films and resin-coated papers that are stable to high temperatures.

Support materials can contain various colorants, pigments, antihalation or acutance dyes if desired. For example, the support can include one or more dyes that provide a blue color in the resulting imaged film. Support materials may be treated using conventional procedures (such as corona discharge) to improve adhesion of overlying layers, or subbing or other adhesion-promoting layers can be used.

Photothermographic Formulations and Constructions:

An organic solvent-based coating formulation for the photothermographic emulsion layer(s) can be prepared by mixing the various components with one or more binders in a suitable organic solvent system that usually includes one or more solvents such as toluene, 2-butanone (methyl ethyl ketone), acetone, or tetrahydrofuran, or mixtures thereof. Methyl ethyl ketone is a preferred coating solvent.

Alternatively, the desired imaging components can be formulated with a hydrophilic binder (such as gelatin, or a gelatin-derivative), or a hydrophobic water-dispersible polymer latex (such as a styrene-butadiene latex) in water or water-organic solvent mixtures to provide aqueous-based coating formulations.

The photothermographic materials can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic and organic matting agents as described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (Kub).

The photothermographic materials may also include a surface protective layer over the one or more emulsion layers. Layers to reduce emissions from the material may also be present, including the polymeric barrier layers described in U.S. Pat. No. 6,352,819 (Kenney et al.), U.S. Pat. No. 6,352,820 (Bauer et al.), U.S. Pat. No. 6,420,102 (Bauer et al.), U.S. Pat. No. 6,667,148 (Rao et al.), and U.S. Pat. No. 6,746,831 (Hunt).

U.S. Pat. No. 6,436,616 (Geisler et al.) describes various means of modifying photothermographic materials to reduce what is known as the "woodgrain" effect, or uneven optical density.

To promote image sharpness, the photothermographic materials can contain one or more layers containing acutance and/or antihalation dyes. These dyes are chosen to have absorption close to the exposure wavelength and are designed to absorb scattered light. One or more antihalation compositions may be incorporated into the support, backside layers, underlayers, or overcoat layers. Additionally, one or more acutance dyes may be incorporated into one or more frontside imaging layers.

Dyes useful as antihalation and acutance dyes include squaraine dyes as described in U.S. Pat. No. 5,380,635 (Gomez et al.), and U.S. Pat. No. 6,063,560 (Suzuki et al.), and EP 1 083 459A1 (Kimura), indolenine dyes as described in EP 0 342 810A1 (Leichter), and cyanine dyes as described in U.S. Pat. No. 6,689,547 (Hunt et al.).

It may also be useful to employ compositions including acutance or antihalation dyes that will decolorize or bleach with heat during processing as described in U.S. Pat. No. 5,135,842 (Kitchin et al.), U.S. Pat. No. 5,266,452 (Kitchin et al.), U.S. Pat. No. 5,314,795 (Helland et al.), and U.S. Pat. No. 6,306,566, (Sakurada et al.), and Japan Kokai 2001-142175 (Hanyu et al.) and 2001-183770 (Hanyu et al.). Useful bleaching compositions are described in Japan Kokai 11-302550 (Fujiwara), 2001-109101 (Adachi), 2001-51371 (Yabuki et al.), and 2000-029168 (Noro).

Other useful heat-bleachable antihalation compositions can include an infrared radiation absorbing compound such as an oxonol dye or various other compounds used in combination with a hexaarylbiimidazole (also known as a "HABI"), or mixtures thereof. HABI compounds are described in U.S. Pat. No. 4,196,002 (Levinson et al.), U.S. Pat. No. 5,652,091 (Perry et al.), and U.S. Pat. No. 5,672,562 (Perry et al.). Examples of such heat-bleachable compositions are described for example in U.S. Pat. No. 6,455,210 (Irving et al.), U.S. Pat. No. 6,514,677 (Ramsden et al.), and U.S. Pat. No. 6,558,880 (Goswami et al.).

Under practical conditions of use, these compositions are heated to provide bleaching at a temperature of at least 90° C. for at least 0.5 seconds (preferably, at a temperature of from about 100° C. to about 200° C. for from about 5 to about 20 seconds).

Mottle and other surface anomalies can be reduced by incorporating a fluorinated polymer as described, for example, in U.S. Pat. No. 5,532,121 (Yonkoski et al.) or by using particular drying techniques as described, for example in U.S. Pat. No. 5,621,383 (Ludemann et al.).

It is preferable for the photothermographic material to include one or more radiation absorbing substances that are generally incorporated into one or more photothermographic layer(s) to provide a total absorbance of all layers on that side of the support of at least 0.1 (preferably of at least 0.6) at the exposure wavelength of the photothermographic material. Where the imaging layers are on one side of the support only, it is also desired that the total absorbance at the exposure wavelength for all layers on the backside (non-imaging) side of the support be at least 0.2.

Photothermographic formulations can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), and U.S. Pat. No. 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by an X-rite Model 361/V Densitometer equipped with 301 Visual Optics, available from X-rite Corporation, (Granville, Mich.).

Preferably, two or more layer formulations are simultaneously applied to a support using slide coating techniques, the first layer being coated on top of the second layer while the second layer is still wet. The first and second fluids used to coat these layers can be the same or different solvents. For example, subsequently to, or simultaneously with, application of the emulsion formulation(s) to the support, a protective overcoat formulation can be applied over the emulsion formulation. Simultaneous coating can be used to apply layers on the frontside, backside, or both sides of the support.

In other embodiments, a "carrier" layer formulation comprising a single-phase mixture of two or more polymers described above may be applied directly onto the support and thereby located underneath the emulsion layer(s) as described in U.S. Pat. No. 6,355,405 (Ludemann et al.). The carrier layer formulation can be simultaneously applied with application of the emulsion layer formulation(s) and any overcoat or surface protective layers.

The photothermographic materials can include one or more antistatic or conductive layers agents in any of the layers on either or both sides of the support. Conductive components include soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), electroconductive underlayers as described in U.S. Pat. No. 5,310,640 (Markin et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.). Particularly useful conductive particles are the non-acicular metal antimonate particles used in a buried backside conductive layer as described and in U.S. Pat. No. 6,689,546 (LaBelle et al.), U.S. Pat. No. 7,018,787 (Ludemann et al.), U.S. Pat. No. 7,022,467 (Ludemann et al.), U.S. Pat. No. 7,067,242 (Ludemann et al), and U.S. Pat. No. 7,144,689 (Ludemann et al.), and in U.S. Patent Application Publication 2006/0046932.

While the carrier and emulsion layers can be coated on one side of the film support, manufacturing methods can also include forming on the opposing or backside of the polymeric support, one or more additional layers, including a conductive layer, antihalation layer, or a layer containing a matting agent (such as silica), or a combination of such layers. Alternatively, one backside layer can perform all of the desired functions.

It is particularly useful that the conductive layers be disposed on the backside of the support and especially where they are buried or underneath one or more other layers such as backside protective layer(s). Such backside conductive layers typically have a resistivity of about $10^5$ to about $10^{12}$ ohm/sq as measured using a salt bridge water electrode resistivity measurement technique. This technique is described in R. A. Elder *Resistivity Measurements on Buried Conductive Layers*, EOS/ESD Symposium Proceedings, Lake Buena Vista, Fla., 1990, pp. 251-254, incorporated herein by reference. [EOS/ESD stands for Electrical Overstress/Electrostatic Discharge].

Still other conductive compositions include one or more fluorochemicals each of which is a reaction product of $R_f$—$CH_2CH_2$—$SO_3H$ with an amine wherein $R_f$ comprises 4 or more fully fluorinated carbon atoms as described in U.S. Pat. No. 6,699,648 (Sakizadeh et al.). Additional conductive compositions include one or more fluorochemicals described in more detail in U.S. Pat. No. 6,762,013 (Sakizadeh et al.).

The photothermographic materials may also usefully include a magnetic recording material as described in *Research Disclosure*, Item 34390, November 1992, or a transparent magnetic recording layer such as a layer containing magnetic particles on the underside of a transparent support as described in U.S. Pat. No. 4,302,523 (Audran et al.).

In a preferred construction, a conductive "carrier" layer formulation comprising a single-phase mixture of two or more polymers and non-acicular metal antimonate particles, may be applied directly onto the backside of the support and thereby be located underneath other backside layers. The carrier layer formulation can be simultaneously applied with application of these other backside layer formulations.

Layers to promote adhesion of one layer to another are also known, such as those described in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described in U.S. Pat. No. 5,928,857 (Geisler et al.).

It is also contemplated that the photothermographic materials include one or more photothermographic layers on both sides of the support and/or an antihalation underlayer beneath at least one photothermographic layer on at least one side of the support. In addition, the materials can have an outermost protective layer disposed over all photothermographic layers on both sides of the support.

Imaging/Development:

The photothermographic materials can be imaged in any suitable manner consistent with the type of material, using any suitable imaging source to which they are sensitive (typically some type of radiation or electronic signal). In some embodiments, the materials are sensitive to radiation in the range of from about at least 100 nm to about 1400 nm. In some embodiments, they materials are sensitive to radiation in the range of from about 300 nm to about 600 nm, more preferably from about 300 to about 450 nm, even more preferably from a wavelength of from about 360 to 420 nm. In preferred embodiments the materials are sensitized to radiation from about 600 to about 1200 nm and more preferably to infrared radiation from about 700 to about 950 nm. If necessary, sensitivity to a particular wavelength can be achieved by using appropriate spectral sensitizing dyes.

Imaging can be carried out by exposing the photothermographic materials to a suitable source of radiation to which they are sensitive, including X-radiation, ultraviolet radiation, visible light, near infrared radiation, and infrared radiation to provide a latent image. Suitable exposure means are well known and include phosphor emitted radiation (particularly X-ray induced phosphor emitted radiation), incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art such as described in *Research*

*Disclosure*, item 38957 (noted above). Particularly useful infrared exposure means include laser diodes emitting at from about 700 to about 950 nm, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

The photothermographic materials also can be indirectly imaged using an X-radiation imaging source and one or more prompt-emitting or storage X-radiation sensitive phosphor screens adjacent to the photothermographic material. The phosphors emit suitable radiation to expose the photothermographic material. Preferred X-ray screens are those having phosphors emitting in the near ultraviolet region of the spectrum (from 300 to 400 nm), in the blue region of the spectrum (from 400 to 500 nm), and in the green region of the spectrum (from 500 to 600 nm).

In other embodiments, the photothermographic materials can be imaged directly using an X-radiation imaging source to provide a latent image.

Thermal development conditions will vary, depending on the construction used but will typically involve heating the imagewise exposed photothermographic material at a suitably elevated temperature, for example, at from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as contacting the material with a heated drum, plates, or rollers, or by providing a heating resistance layer on the rear surface of the material and supplying electric current to the layer so as to heat the material. A preferred heat development procedure for photothermographic materials includes heating within a temperature range of from 110 to 150° C. for 25 seconds or less, for example, at least 3 and up to 25 seconds (and preferably for 20 seconds or less) to develop the latent image into a visible image having a maximum density (Dmax) of at least 3.0. Line speeds during development of greater than 61 cm/min, such as from 61 to 200 cm/min, can be used.

Thermal development of photothermographic materials is carried out with the material being in a substantially water-free environment and without application of any solvent to the material.

Use as a Photomask:

The photothermographic materials can be sufficiently transmissive in the range of from about 350 to about 450 nm in non-imaged areas to allow their use in a method where there is a subsequent exposure of an ultraviolet or short wavelength visible radiation sensitive imageable medium. The photothermographic materials absorb ultraviolet or short wavelength visible radiation in the areas where there is a visible image and transmit ultraviolet or short wavelength visible radiation where there is no visible image. The photothermographic materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This method is particularly useful where the imageable medium comprises a printing plate and the photothermographic material serves as an image-setting film.

Thus, in some other embodiments wherein the photothermographic material comprises a transparent support, the image-forming method further comprises, after steps (A) and (B) noted above:

(C) positioning the exposed and heat-developed photothermographic material between a source of imaging radiation and an imageable material that is sensitive to the imaging radiation, and (D) exposing the imageable material to the imaging radiation through the visible image in the exposed and heat-developed photothermographic material to provide an image in the imageable material.

The following examples are provided to illustrate the practice of the present invention and the invention is not meant to be limited thereby.

Materials and Methods for the Examples:

All materials used in the following examples are readily available from standard commercial sources, such as Aldrich Chemical Co. (Milwaukee Wis.) unless otherwise specified. All percentages are by weight unless otherwise indicated. The following additional terms and materials were used.

Many of the chemical components used herein are provided as a solution. The term "active ingredient" means the amount or the percentage of the desired chemical component contained in a sample. All amounts listed herein are the amount of active ingredient added unless otherwise specified.

ACRYLOID® A-21 is an acrylic copolymer available from Rohm and Haas (Philadelphia, Pa.).

BZT is benzotriazole.

CAB 171-15S is a cellulose acetate butyrate resin available from Eastman Chemical Co (Kingsport, Tenn.).

DESMODUR® N3300 is a trimer of an aliphatic hexamethylene diisocyanate available from Bayer Chemicals (Pittsburgh, Pa.).

Developer-1 (DEV-1) is 2'-isobutylidene-bis(4,6-dimethylphenol) available from Great Lakes Chemical (West Lafayette, Ind.).

MEK is methyl ethyl ketone (or 2-butanone).

PIOLOFORM® BL-16 is reported to be a polyvinyl butyral resin having a glass transition temperature of about 84° C. PIOLOFORM® BM-18 is reported to be a polyvinyl butyral resin having glass transition temperature of about 70° C. Both are available from Wacker Polymer Systems (Adrian, Mich.).

Vinyl Sulfone-1 (VS-1) is described in U.S. Pat. No. 6,143,487 and has the structure shown below.

(VS-1)

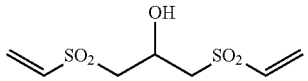

Antifoggant AF-A is 2-pyridyltribromomethylsulfone and has the structure shown below.

(AF-A)

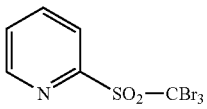

Antifoggant AF-B is ethyl-2-cyano-3-oxobutanoate. It is described in U.S. Pat. No. 5,686,228 (Murray et al.) and has the structure shown below.

(AF-B)

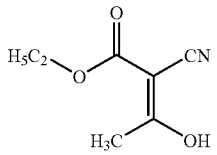

Acutance Dye AD-1 has the following structure:

(AD-1)

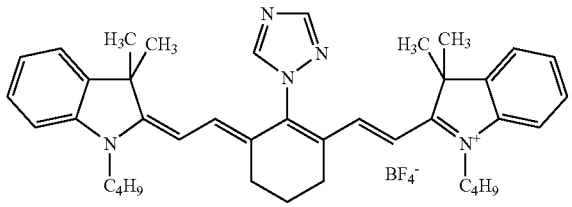

Tinting Dye TD-1 has the following structure:

(TD-1)

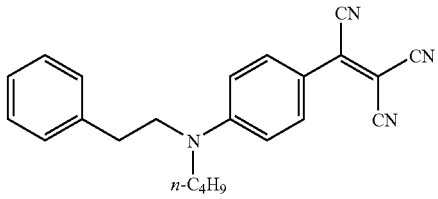

Sensitizing Dye A is described in U.S. Pat. No. 5,541,054 (Miller et al.) has the structure shown below.

(Sensitizing Dye A)

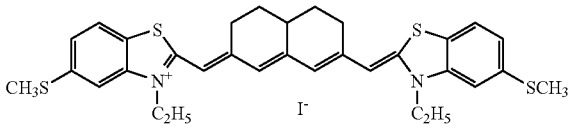

Support Dye SD-1 has the following structure:

(SD-1)

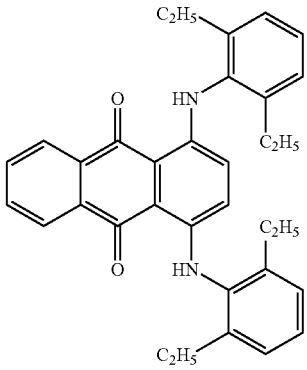

EXAMPLE

Sample 1

Preparation of Control Photothermographic Material

A preformed iridium and copper doped core-shell silver iodobromide emulsion was prepared as described in U.S. Pat. No. 5,939,249 (noted above) and incorporated herein by reference.

Preparation of Silver Halide/Silver Carboxylate Soap:

A control sample of a silver halide/silver carboxylate soap was prepared as described in U.S. Pat. No. 5,434,043 (noted above) and described below.

I. Ingredients:

1. Pre-formed iridium and copper doped silver halide emulsion 0.10 mole (89 g at 890 g/mole) in 1 liter water at 55° C.
2. 88.5 g of NaOH in 1.5 liters of water.
3 370 g of $AgNO_3$ in 1.5 liters of water.
4. 118 g of Humko Type 9718 fatty acid (available from Witco. Co., Memphis, Tenn.)
5. 570 g of Humko Type 9022 fatty acid (available from Witco. Co., Memphis, Tenn.)
6. 19 ml of conc. $HNO_3$ in 50 ml of water.

II. Reaction:

Step 1. Ingredients #4 and #5 were dissolved in 12 liters of water at 80° C. and mixed for 15 minutes.

Step 2. Ingredient #2 was added to Step 1 at 80° C. and mixed for 5 minutes to form a dispersion.

Step 3. Ingredient #6 was added to the dispersion at 80° C. The dispersion was cooled to 55° C. and stirred for 25 minutes.

Step 4. Ingredient #1 was added to the dispersion at 55° C. and mixed for 5 minutes.

Step 5. Ingredient #3 was added to the dispersion at 55° C. and mixed for 10 minutes.

Step 6. The dispersion was filtered and washed until wash water had a resistivity of 20,000 ohm/cm$^2$.

Step 7. The photothermographic silver carboxylate soap was dried at 45° C. for 72 hours.

The formulation for Sample 1 is shown below in TABLE I.

Preparation of Photothermographic Emulsion Formulation:

A photothermographic emulsion was prepared essentially as described in U.S. Pat. No. 5,939,249 (noted above). The emulsion was homogenized to 27.2% solids in MEK containing 2% PIOLOFORM® BM-18 polyvinyl butyral binder.

To 196 parts of this emulsion maintained at 20° C. was added 1.6 parts of a 15% solution of pyridinium hydrobromide perbromide in methanol with continued stirring. After 60 minutes of mixing, 2.1 parts of an 11% zinc bromide solution in methanol was added. Stirring was continued and after 30 minutes, a solution of 0.15 parts of 2-mercapto-5-methylbenzimidazole, 0.007 parts Sensitizing Dye A, 1.7 pairs of 2-(4-chlorobenzoyl)benzoic acid, 10.8 parts of methanol, and 3.8 parts of MEK was added.

After stirring for another 75 minutes, 26 parts of PIOLOFORM® BM-18 polyvinyl butyral and 20 parts of PIOLOFORM® BL-16 were added, the temperature was lowered to 10° C., and mixing was continued for another 30 minutes.

Photothermographic Coating Formulation:

A coating formulation for the photothermographic emulsion formulation was prepared as follows:

| | |
|---|---|
| Solution A: | |
| Antifoggant A: | 1.2 parts |
| Tetrachlorophthalic acid | 0.37 parts |
| 4-Methylphthalic acid | 0.60 parts |
| MEK | 16 parts |
| Methanol | 0.28 parts |
| Developer-1 | 9.5 parts |
| Solution B: | |
| DESMODUR ® N3300 | 0.66 parts |
| MEK | 0.33 parts |
| Solution C: | |
| Phthalazine | 1.3 parts |
| MEK | 6.3 parts |

The photothermographic coating formulation was completed by adding Solution A, Developer-1, Solution B, and Solution C, 5 minutes apart. Mixing was maintained.

minutes was followed by Steps #3-7 as described for Sample 1. The formulation for Sample 2 is shown below in TABLE I.

Photothermographic emulsions were prepared, coated, and dried as described for Sample 1.

Samples 3-5

Preparation of Inventive Photothermographic Materials

Inventive silver halide/silver carboxylate soaps were prepared essentially as described for Sample 1 but using various ratios of sodium hydroxide and lithium hydroxide in Step #2 and adding the lithium hydroxide solution 15 minutes after the addition of the sodium hydroxide solution. Mixing for 5 minutes was followed by Steps #3-7 as described in the preparation of Sample 1. The formulations for Samples 3-5 are shown below in TABLE I.

Photothermographic emulsions were prepared, coated, and dried as described for Sample 1.

TABLE I

| Sample | Mole Ratio | NaOH | LiOH | Time to LiOH Addition |
|---|---|---|---|---|
| 1-Control | 100% NaOH | 88.5 g in 1.5 liter $H_2O$ | None | No LiOH Added |
| 2-Comparive | 85% NaOH 15% LiOH | 75.23 g in 1.3 liter $H_2O$ | 7.92 g in 0.20 liter $H_2O$ | Added Simultaneously |
| 3-Inventive | 90% NaOH 10% LiOH | 79.65 g in 1.35 liter $H_2O$ | 5.28 g in 0.15 liter $H_2O$ | 15 Minutes |
| 4-Inventive | 85% NaOH 15% LiOH | 75.23 g in 1.3 liter $H_2O$ | 7.92 g in 0.20 liter $H_2O$ | 15 Minutes |
| 5-Inventive | 80% NaOH 20% LiOH | 70.80 g in 1.2 liter $H_2O$ | 10.56 g in 0.3 liter $H_2O$ | 15 Minutes |

Protective Overcoat Formulation:

A protective overcoat formulation for the photothermographic emulsion layer was prepared as follows:

| | |
|---|---|
| ACRYLOID ® A-2] | 2.9 parts |
| CAB 171-15S | 32 parts |
| MEK | 459 parts |
| Vinyl sulfone (VS-1) | 1.6 parts |
| Benzotriazole | 0.9 parts |
| Antifoggant B | 0.8 parts |
| Acutance dye (AD-1) | 0.5 parts |
| Tinting dye (TD-1) | 0.02 parts |

The photothermographic and overcoat formulations were simultaneously dual knife coated onto a 178 μm polyethylene terephthalate support to provide photothermographic materials with the topcoat being farthest from the support. The web (support and applied layers) was conveyed at a rate of m/min during coating and drying. Immediately after coating, the samples were dried in an oven at about 85° C. for 5 minutes. The imaging layer formulation was coated to provide about 2 $g/m^2$ of silver dry coating weight. The topcoat formulation was coated to provide about 2.6 $g/m^2$ dry coating weight.

Sample 2

Preparation of Comparative Photothermographic Material

A comparative silver halide/silver carboxylate soap sample was prepared in a manner identical to that described for Sample 1 but adding a mixture of sodium hydroxide and lithium hydroxide (85/15 mole %) in Step #2. Mixing for 5

Imaging and Evaluation of Samples:

The coated and dried photothermographic materials prepared above were cut into 1.5 inch×10 inch strips (3.6 cm×25.4 cm) and exposed through a 10 cm continuous wedge with a scanning, laser sensitometer incorporating an 811 nm laser diode. The total scan time for the sample was 6 seconds. The samples were developed using a heated roll processor for 15 seconds at 252° F. (122.2° C.).

Densitometry measurements were made on a custom-built computer scanning densitometer meeting ISO Standards 5-2 and 5-3. They are believed to be comparable to measurements from commercially available densitometers. Density of the wedges was then measured using a filter appropriate to the sensitivity of the photothermographic material to obtain graphs of density versus log exposure (that is, D log E curves). Dmin is the density of the non-exposed areas after development.

The data, shown below in TABLE II, demonstrate that the photothermographic materials prepared from silver halide/silver carboxylate soaps wherein the silver carboxylate is formed by sequential addition of sodium hydroxide followed by lithium hydroxide (Samples 3, 4, and 5) have both a lower initial Dmin and display a smaller increase in Dmin upon aging then similarly prepared samples prepared using either sodium hydroxide alone or prepared using a mixture of sodium hydroxide and lithium hydroxide. The low values of ΔDmin after 18 months of aging for Samples 3, 4, and 5 are particularly noteworthy.

The data for Speed-2, shown below in TABLE III, further demonstrate that this improvement in "shelf-aging Dmin"

does not occur at the expense of sensitometric photospeed. The low values of ΔSpeed-2 after 18 months of aging for Samples 3, 4, and 5 is again particularly noteworthy.

TABLE II

Change in $D_{min}$ ($\Delta D_{min}$) with Aging

| Sample | Addition of LiOH | $D_{min}$ Initial | $D_{min}$ 3 Months | $D_{min}$ 6 Months | $D_{min}$ 9 Months | $D_{min}$ 12 Months | $D_{min}$ 18 Months | $\Delta D_{min}$ 18 Months |
|---|---|---|---|---|---|---|---|---|
| 1-Control | — | 0.210 | 0.230 | 0.238 | 0.255 | 0.305 | 0.345 | 0.135 |
| 2-Comparative | Simult. | 0.202 | 0.215 | 0.220 | 0.225 | 0.230 | 0.239 | 0.037 |
| 3-Inventive | 15 min. | 0.200 | 0.207 | 0.210 | 0.213 | 0.214 | 0.215 | 0.015 |
| 4-Inventive | 15 min. | 0.201 | 0.206 | 0.205 | 0.207 | 0.210 | 0.210 | 0.009 |
| 5-Inventive | 15 min. | 0.197 | 0.201 | 0.203 | 0.205 | 0.206 | 0.205 | 0.008 |

TABLE III

Change in Speed-2 (Δ Speed-2) with Aging

| Sample | Addition of LiOH | Speed-2 Initial | Speed-2 3 Months | Speed-2 6 Months | Speed-2 9 Months | Speed-2 12 Months | Speed-2 18 Months | Δ Speed-2 18 Months |
|---|---|---|---|---|---|---|---|---|
| 1-Control | — | 1.77 | 1.74 | 1.70 | 1.70 | 1.75 | 1.73 | −0.04 |
| 2-Comparative | Simult. | 1.74 | 1.75 | 1.72 | 1.71 | 1.74 | 1.73 | −0.01 |
| 3-Inventive | 15 min. | 1.77 | 1.78 | 1.74 | 1.73 | 1.75 | 1.73 | −0.04 |
| 4-Inventive | 15 min. | 1.77 | 1.75 | 1.72 | 1.71 | 1.73 | 1.70 | −0.07 |
| 5-Inventive | 15 min. | 1.71 | 1.69 | 1.67 | 1.67 | 1.68 | 1.67 | −0.04 |

The invention has been described in detail with particular reference to certain preferred embodiments thereof, but it will be understood that variations and modifications can be effected within the spirit and scope of the invention.

The invention claimed is:

1. A method of forming a silver soap of a long chain carboxylic acid comprising:

(A) preparing a dispersion of a long chain carboxylic acid in water, with no alkali or ammonia salt of said acid present in the dispersion while said long chain carboxylic acid is maintained above its melting point but below the boiling point of the dispersion;

(B) converting a first portion of said long chain carboxylic acid to one or more alkali metal salts of said long chain carboxylic acid by the addition of one or more alkali metal hydroxides;

(C) converting the remainder of said long chain carboxylic acid to one or more alkali metal salts of said long chain carboxylic acid by the addition of one or more alkali metal hydroxides;

(D) cooling the dispersion, and thereafter; and (E) converting the mixture of said long chain alkali metal salts of said long chain carboxylic acid to a silver soap of said long chain carboxylic acid;

so long as one of said alkali metal hydroxides in step (B) or (C) but not both is lithium hydroxide.

2. The method of claim 1 further comprising adding preformed silver halide grains at any step in the process of preparing the silver soap of a long chain carboxylic acid to form a silver halide/silver carboxylate soap.

3. The method of claim 2 wherein adding the preformed silver halide occurs between steps (D) and (E).

4. The method of claim 1 wherein the alkali metal hydroxide in step (B) is sodium hydroxide, potassium hydroxide, ammonium hydroxide or mixtures thereof, and the alkali metal hydroxide in step (C) is lithium hydroxide.

5. The method of claim 4 wherein the ratio of lithium hydroxide in step (C) to alkali metal hydroxide in step (B) is from about 2 to about 80 mole %.

6. The method of claim 4 wherein the ratio of lithium hydroxide in step (C) to alkali metal hydroxide in step (B) is from about 5 to about 25 mole %.

7. The method of claim 4 wherein the alkali metal hydroxide in step (B) is sodium hydroxide and the alkali metal hydroxide in step (C) is lithium hydroxide.

8. The method of claim 1 wherein said long chain carboxylic acid is a long-chain aliphatic carboxylic acid having 10 to 30 carbon atoms or a mixture of long-chain aliphatic carboxylic acids, at least one of which is behenic acid.

9. A method of preparing a photothermographic coating formulation by chemically and spectrally sensitizing the silver halide/silver carboxylate soap of claim 2.

10. The method of claim 9 wherein said spectral sensitizing dye spectrally sensitizes the silver halide grains of said photothermographic emulsion to from about 600 to about 1100 nm.

11. The method of claim 9 wherein said chemical sensitization is carried out by decomposing an organic sulfur containing compound on or around said silver halide grains to chemically sensitize said silver halide grains.

12. The method of claim 1 further comprising converting a portion of said silver long chain carboxylic acid to photosensitive silver halide by one or more additions of a halogen-containing compound in an amount of from about $10^{-4}$ to about $10^{-1}$ mol of halogen atom per mol of reducible silver ions.

13. The method of claim 2 further comprising adding a binder and a reducing agent composition to said silver halide/silver carboxylate soap to form a photothermographic coating formulation.

14. The method of claim 13 wherein said reducing agent composition comprises a hindered phenol, a hindered bisphenol, or a hindered tris-phenol reducing agent and said binder is a hydrophobic binder or an aqueous latex binder.

15. The method of claim 13 further comprising coating said photothermographic emulsion formulation on a support.

16. A method of preparing a photothermographic material comprising:

(A) preparing a dispersion of a long chain carboxylic acid in water, with no alkali or ammonia salt of said acid present in the dispersion while the acid is maintained above its melting point but below the boiling point of the dispersion;

(B) converting a first portion of the long chain carboxylic acid to one or more alkali metal salts of the long chain carboxylic acid by the addition of one or more alkali metal hydroxides;

(C) converting the remainder of the long chain carboxylic acid to one or more alkali metal salts of the long chain carboxylic acid by the addition of one or more alkali metal hydroxides;

(D) cooling the dispersion;

(E) adding a performed silver halide, and thereafter;

(F) converting the mixture of long chain alkali metal salts of the carboxylic acid to a silver soap of said long chain carboxylic acid, so long as one of the alkali metal hydroxides in step (B) or (C) but not both is lithium hydroxide;

(G) adding a binder to form a photothermographic emulsion formulation;

(H) adding a hindered bis-phenol reducing agent to form a photothermographic coating formulation; and (I) coating and drying said photothermographic emulsion formulation on a support to provide a photothermographic imaging material.

17. The method of claim 16 wherein, simultaneously or subsequent to step (D), a protective overcoat formulation is coated over said photothermographic imaging layer.

18. The method of claim 16 wherein, prior to or simultaneously with step (D), a carrier layer is coated on said support underneath said photothermographic imaging layer.

19. The method of claim 16 further comprising coating a conductive layer on a non-imaging side of said support.

20. A method of forming a visible image comprising:

(A) imagewise exposing the photothermographic material prepared as described in claim 17 to electromagnetic radiation to form a latent image; and (B) simultaneously or sequentially, heating the exposed photothermographic material to develop the latent image into a visible image.

* * * * *